US008409374B2

(12) United States Patent
Lumley et al.

(10) Patent No.: US 8,409,374 B2
(45) Date of Patent: Apr. 2, 2013

(54) HEAT TREATMENT OF ALUMINIUM ALLOY HIGH PRESSURE DIE CASTINGS

(75) Inventors: Roger Neil Lumley, South Clayton (AU); Robert Geoffrey O'Donnell, South Clayton (AU); Dayalan Romesh Gunasegaram, South Clayton (AU); Michel Givord, South Clayton (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 0 days.

(21) Appl. No.: 11/793,023

(22) PCT Filed: Dec. 19, 2005

(86) PCT No.: PCT/AU2005/001909

§ 371 (c)(1),
(2), (4) Date: May 19, 2008

(87) PCT Pub. No.: WO2006/066314

PCT Pub. Date: Jun. 29, 2006

(65) Prior Publication Data

US 2009/0038720 A1 Feb. 12, 2009

(30) Foreign Application Priority Data

Dec. 23, 2004 (AU) ..... 2004907329

(51) Int. Cl.
*C22F 1/043* (2006.01)

(52) U.S. Cl. ..... 148/549; 148/700

(58) Field of Classification Search ..... 148/549, 148/700, 698, 699

See application file for complete search history.

(56) References Cited

U.S. PATENT DOCUMENTS

| | | | |
|---|---|---|---|
| 2,799,066 | A | 7/1957 | Federman et al. |
| 2,864,140 | A | 12/1958 | Morganstern |
| 3,382,910 | A | 5/1968 | Radtke |
| 3,999,593 | A | 12/1976 | Kaiser |
| 4,104,089 | A | 8/1978 | Miki |
| 4,463,793 | A | 8/1984 | Thurner |

(Continued)

FOREIGN PATENT DOCUMENTS

| | | |
|---|---|---|
| EP | 0 480 402 | 4/1992 |
| EP | 0 796 926 | 9/1997 |

(Continued)

OTHER PUBLICATIONS www.alcoa.com; AVDC Process, www.alcoa.com, 2007

(Continued)

*Primary Examiner* — Roy King
*Assistant Examiner* — Janelle Morillo
(74) *Attorney, Agent, or Firm* — Jacobson Holman PLLC

(57) ABSTRACT

A method for the heat treatment of a casting produced by high pressure die casting, that may exhibit blister forming porosity in the as-cast condition, of an age-hardenable aluminum alloy, includes solution treating the casting by heating the casting to and within a temperature range enabling solute elements to be taken into solid solution. The casting then is cooled to terminate the solution treatment by quenching the casting to a temperature below 100° C. The cooled casting is held in a temperature range enabling natural and/or artificial ageing. The solution treatment is conducted to achieve a level of solute element solution enabling age-hardening without expansion of pores in the casting causing unacceptable blistering of the casting.

24 Claims, 16 Drawing Sheets

U.S. PATENT DOCUMENTS

| | | | | |
|---|---|---|---|---|
| 4,476,911 | A | 10/1984 | Lossack et al. | |
| 4,589,932 | A | 5/1986 | Park | |
| 4,760,240 | A * | 7/1988 | Iikawa et al. | 219/121.64 |
| 4,786,340 | A | 11/1988 | Ogawa | |
| 4,787,436 | A | 11/1988 | Ozeki et al. | |
| 5,076,344 | A | 12/1991 | Fields et al. | |
| 5,246,055 | A | 9/1993 | Fields et al. | |
| 5,417,081 | A | 5/1995 | Rudick | |
| 5,582,659 | A | 12/1996 | Hashimoto | |
| 5,809,789 | A | 9/1998 | Baker | |
| 5,846,350 | A | 12/1998 | Bergsma | |
| 6,419,769 | B1 | 7/2002 | Lee et al. | 148/552 |
| 6,773,666 | B2 | 8/2004 | Lin et al. | 420/546 |
| 6,994,760 | B2 | 2/2006 | Benedictus | |
| 2002/0106301 | A1 | 8/2002 | O'Connor | 420/548 |

FOREIGN PATENT DOCUMENTS

| | | |
|---|---|---|
| FR | 2588017 | 3/1987 |
| FR | 2841263 | 12/2003 |
| JP | 7-310154 | 11/1995 |
| JP | 10-298689 | 11/1998 |
| JP | 11-29843 | 2/1999 |
| JP | 11029843 A * | 2/1999 |

OTHER PUBLICATIONS

ASM Handbook, Stefanescu et al., 758-759, Formerly Ninth Edition, Metals Handbook, vol. 15, Casting, 1988.

Lasa, L. et al., "*Evolution of the main intermetallic phases in Al-Si-Cu-Mg casting allows during solution treatment*," Journal of Materials Science 39(4), pp. 1343-1355 (Feb. 2004) and abstract.

Dietrich G. Altenpohl, *Aluminum: Technology, Applications, and Environment, A Profile of A Modern Metal, Aluminum form within-the Sixth Edition*, sections 6.3.3.3 and 6.3.3.4.

Bonollo et al, *Gravity and Low Pressure Die Casting of Aluminum Alloys: A Technical and Economical Benchmark*, La Metallurgica Italiana, Jun. 2005 (pp. 1-15).

*Tougher Casting*, from www.economist.com, Feb. 26, 2008 (1 page).

Certified accurate English translation of JP 11-29843, 10 pages, 1999.

Extract from the materials database Metals Bank, 2 pages, 2010.

Kaufman, Aluminum Alloy Castings: Properties, Processes, and Applications, Dec. 2004, pp. 29-31, total 4 pages, see Paragraph 10 of Declaration.

Baldini et al, Process Simulation of Microstructure and Relationship with Mechanical Properties in Diecastings; vol. 20, No. 2, 2002, pages.

Bonollo et al, Gravity and low pressure die casting of aluminium alloys: a technical and economical benchmark, La Metallurgia Italiana, Jun. 2005, pp. 23-32, total 10 pages, see Paragraph 13 of Declaration.

Niu et al, Vacuum assisted high pressure die casting of aluminium alloys, J. of Materials Processing technology 105 (2000) 119-127, total 9 pages, see Paragraph 14 of Declaration.

* cited by examiner (a) as-cast (b) 16h 545°C (c) 0.25h 545°C
(d) 0.25h 535°C (e) 0.25h 525°C (f) 0.25h 515°C
(g) 0.25h 505°C (h) 0.25h 495°C (i) 0.25h 485°C (a) as received
(b) 0.25h 530°C
(c) 0.25h 520°C
(d) 0.25h 510°C
(e) 0.25h 500°C
(f) 0.25h 490°C
(g) 0.25h 480°C
(h) 0.25h 470°C
(i) 0.25h 460°C
(j) 0.25h 440°C

HEAT TREATMENT OF ALUMINIUM ALLOY HIGH PRESSURE DIE CASTINGS

FIELD OF THE INVENTION

This invention relates to a method for the heat treatment of castings of high pressure die cast age-hardenable aluminium alloys.

BACKGROUND TO THE INVENTION

High pressure diecasting (HPDC) is widely used to mass produce metal components that are required to have close dimensional tolerances and smooth surface finishes. One disadvantage, however, is that parts produced by conventional HPDC are relatively porous. Internal pores arise because of shrinkage porosity during solidification, and also the presence of entrapped gases such as air, hydrogen or vapours formed from the decomposition of die wall lubricants.

Castings made from HPDC aluminium alloys are not considered to be amenable to heat treatment. This follows because the internal pores containing gas or gas forming compounds expand during conventional solution treatment at high temperatures (eg. 500° C.) resulting in the formation of surface blisters on the castings. The presence of these blisters is visually unacceptable. Furthermore, expansion of internal pores during the high temperature solution treatment may have adverse effects both on the dimensional stability and mechanical properties of affected high pressure die castings.

As discussed in Altenpohl "Aluminium: Technology, Applications, and Environment", Sixth Edition, published by The Aluminium Association and The Minerals, Metals and Materials Society, —see pages 96 to 98—there are techniques which allow high pressure die castings to become relatively pore-free and thus heat treatable in the absence of blistering. These techniques include vacuum die casting, pore-free die casting, squeeze casting and thixocasting, all of which involve cost penalties.

Of these techniques, vacuum systems are applied most frequently, with the aim of reducing porosity within the casting. In many cases the remaining level of porosity is still too high to allow heat treatment. However, there are some exceptions.

For example, in U.S. Pat. No. 6,773,666 to Lin et. al., an improved Al—Si—Mg—Mn alloy is disclosed as able to be high pressure die cast using Alcoa's AVDC die casting technique to produce extremely low porosity in resultant castings. The alloy composition contains less than 0.15Fe, less than 0.3Ti, less than 0.04Sr, and is substantially copper free, chromium free and beryllium free. It is similar to the casting alloy AA357 as well as the Australian casting alloy designations CA601 and CA603 (Aluminium Standards and Data—Ingots and Castings, 1997). The AVDC method uses very high vacuum pressure to produce components that are relatively pore free, and are reported as being weldable and heat treatable (see, for example, http://www.alcoa.com/locations/germany_soest/en/about/avdc.asp, 2005). In the prior art of Lin et. al., the castings were examined by X-ray analysis and found to be in excellent condition in regards to porosity contents. This high vacuum casting technique, followed by the heat treatment stages of solution treatment from 950-1020° F. (510-549° C.) for 10-45 minutes, quenching into water at 70 to 170° F. (ambient to 77° C.) and artificial ageing for 1-5 h at 320-360° F. (160-182° C.) was believed to achieve adequate properties for aerospace applications. Following the heat treatment schedules taught within this prior art, minor blistering was reported to have appeared upon the surfaces of the alloy examined, and was believed to have resulted from entrapped lubricant. However, the alloy was disclosed as being of high structural integrity and deemed suitable for aerospace applications.

Another example of a technique to reduce or remove porosity and thus facilitate heat treatment is disclosed in U.S. Pat. No. 4,104,089 to Miki wherein components produced from Al—Si—Mg—Mn alloy were able to be heat treated conventionally following a pore-free diecasting process. That diecasting process is based on earlier work evidently that of U.S. Pat. No. 3,382,910 to Radtke et al in which the die cavity is purged with a reactive gas that combines with the molten metal to reduce the level of porosity in resultant castings.

The conventional heat treatment procedure for aluminium alloys normally involves the following three stages:

(1) solution treatment at a relatively high temperature, below the melting point of the alloy, often for times exceeding 8 hours or more to dissolve its alloying (solute) elements and homogenise or modify the microstructure;

(2) rapid cooling, or quenching, such as into cold or hot water, to retain the solute elements in a supersaturated solid solution; and (3) ageing the alloy by holding it for a period of time at one, sometimes at a second, temperature suitable for achieving hardening or strengthening through precipitation.

The strengthening resulting from ageing occurs because the solute taken into supersaturated solid solution forms precipitates which are finely dispersed throughout the grains and which increase the ability of the alloy to resist deformation by the process of slip. Maximum hardening or strengthening occurs when the ageing treatment leads to the formation of a critical dispersion of at least one type of these fine precipitates.

An alternative to the heat treatment procedure mentioned above is what is known as a T5 temper. In this case, the alloy is quenched immediately following casting while it retains some of its elevated temperature, and then artificially aged to produce more moderate improvements in properties.

Solution treatment conditions differ for different alloy systems. Typically, for casting alloys based around Al—Si—X, solution treatment is conducted at 525° C. to 540° C. for several hours to cause appropriate spheroidisation of the Si particles within the alloy and to achieve an appropriate saturated solid solution suitable for heat treatment. For example, Metals Handbook, $9^{th}$ ed. vol. 15 p. 758-759 provides times and temperatures typical for solution treatment of casting alloys to provide these changes. Typically, the time of solution treatment for the alloys based on Al—Si—X is given as being between 4 and 12 hours, and for many alloys 8 hours or more, depending on the specific alloy and temperature of solution treatment. The time of solution treatment is normally considered to commence once an alloy has reached within a small margin of the desired solution treatment temperature (eg. within 10° C.), and this can vary with furnace characteristics and load size. However, this process, if applied to conventional aluminium alloy high pressure diecastings, is unsuitable because it will cause substantial unacceptable surface blistering on the diecastings.

SUMMARY OF THE INVENTION

The present invention provides a method for the heat treatment of age hardenable aluminium alloy high pressure die castings (HPDC) which obviates the need to use the more expensive alternative component production techniques as discussed in Altenpohl and other sources. The invention is applicable to all age hardenable aluminium alloy HPDC castings but is particularly applicable to those that contain internal pores residual from the die casting process. The castings may be produced by what can be regarded as a conventional or usual HPDC technique, such as with a cold-chamber die casting machine, and without a need to determine the level of porosity in resultant castings in order to select those that are sufficiently pore-free as to be amenable to conventional heat treatment. That is, the alloys are cast under pressure to fill one or more mould cavities in a die without the application of a high vacuum by which air is withdrawn from the die cavity and without the use of a reactive gas to purge air from the die cavity. Thus, the alloy is able to be cast in a die which, at the onset of casting, is exposed to the natural, surrounding atmosphere and is at ambient gas pressure. As a consequence, the casting to which this invention is applicable can be characterised by the presence of porosity. The presence of porosity can be determined by several techniques. For example, optical microscopy of a cross section of as-cast alloy will reveal porosity. X-ray radiography will also reveal porosity, but only that which is resolvable or large enough to be easily seen.

The present invention provides a method for the heat treatment of a casting produced by high pressure die casting of an age-hardenable aluminium alloy, wherein the method includes the steps of:

(a) solution treating the casting by heating the casting to and within a temperature range enabling solute elements to be taken into solid solution;
(b) cooling the casting to terminate step (a) by quenching the casting to a temperature below 100° C.; and
(c) ageing the casting after step (b) by holding the casting in a temperature range enabling natural or artificial ageing, wherein step (a) is conducted to achieve a level of solute element solution enabling age-hardening without expansion of pores in the casting causing unacceptable blistering of the casting.

In one form, the present invention provides a method for the heat treatment of a high pressure die casting of an age-hardenable aluminium alloy typically exhibiting porosity, wherein the method includes the steps of:

(a) heating the die casting to and within a temperature range that allows solute elements to be taken into solid solution (solution treatment) wherein the heating is:
  (i) to and within a range of 20 to 150° C. below the solidus melting temperature for the alloy of the casting, and
  (ii) for a period of time of less than 30 minutes;
(b) cooling the casting from the temperature range for step (a) by quenching the casting into a fluid quenchant at a temperature between 0 and 100° C.,
(c) ageing the quenched casting from step (b) by holding the casting in a temperature range enabling ageing to produce an age-hardened casting which exhibits hardening or strengthening of the alloy, whereby blistering of the age-hardened casting is least substantially minimised or prevented.

The quenching in step (b) may be to a temperature suitable for the strengthening of step (c). The ageing in step (c) may be natural ageing or artificial ageing. Thus, in the former case, the alloy may be held at ambient temperature, that is at the prevailing atmospheric temperature which may range from 0° C. to 45° C., for example from 15° C. to 25° C., such that heating is not necessary. Alternatively, the casting may be artificially aged by heating above ambient temperature. Artificial ageing preferably is by heating in the range of from 50° C. to 250° C., most preferably in the range of from 130° C. to 220° C.

The duration of the heating in step (a) may include the time for heating to the lower limit of the range of 20 to 150° C. below the solidus melting temperature. On reaching that range, the casting can be held at one or more temperature levels within the range for a duration of time of less than 30 minutes. Alternatively, the heating of the casting in stage (a) can be non-isothermal within the specified range of temperatures.

Step (a) may be conducted, at least in part, non-isothermally, or conducted substantially completely non-isothermally. Alternatively, step (a) may be conducted substantially isothermally.

In step (c), where the casting is subject to artificial ageing, the casting may be held at one or more temperature levels within the artificial ageing temperature range, or the ageing can be conducted non-isothermally such as by the temperature of the casting can be ramped up to a maximum within the range.

Step (c) may be conducted such that the age-hardened casting is in an underaged condition, peak aged condition, or an overaged condition, compared in each case to a full T6 temper. In the process of the invention, the casting may be cold worked between step (b) and step (c). Cooling of the casting from the ageing temperature for step (c), where step (c) provides artificial ageing, may be by quenching. Alternatively, the casting may be slowly cooled from an artificial ageing temperature in step (b), such as by slow cooling in air or another medium. The casting following step (c) typically is devoid of dimensional change from its as cast condition.

For a conventional heat treatment, the time at the solution treatment temperature is to provide alloy homogenisation and development of a maximum solute content solid solution. In contrast, in step (a) of the present invention the alloy is not fully homogenised or equilibrated due to the short time-frame used, and the solid solution formed is not expected to be completely at equilibrium at that temperature for its given duration. That is, the solution treatment in effect is partial with respect to current practice in heat treatment of aluminium alloys.

The heat treated casting that results from the present invention may be produced by a conventional or usual high pressure die casting technique in which die cavity fill is by substantially fully molten alloy. As a high vacuum is not applied in that technique to withdraw air from the die cavity, turbulence in the alloy can result in entrapped gases and internal porosity. Castings may also be produced by a variant of that technique disclosed in International patent application WO026062 by Cope et al and assigned to the assignee in respect of the present invention. In the technique of Cope et al, die cavity fill is by an advancing front of semi-solid alloy, and resultant porosity is more finely distributed within the alloy. However, heat treatment of a casting produced by this variant of conventional or usual HP die casting also can result in blistering in some instances, such that the casting of this variant also benefits from application of the present invention.

The method of the invention can be applied to a high pressure die casting produced from any age-hardenable aluminium alloy. However, alloys for which the present invention is most suitable are Al—Si alloys having 4.5 to 20 wt % Si, 0.05 to 5.5 wt % Cu, 0.1 to 2.5 wt % Fe and 0.01 to 1.5 wt % Mg. The alloys optionally may contain at least one of Ni up to 1.5 wt %, Mn up to 1 wt % and Zn up to 3.5 wt %. In each case, the balance apart from incidental impurities comprises aluminium. The incidental impurities which may be present include, but are not restricted to Ti, B, Be, Cr, Sn, Pb, Sr, Bi, In, Cd, Ag, Zr, Ca, other transition metal elements, other rare earth elements and rare earth compounds, carbides, oxides, nitrides, anhydrides and mixtures of these compounds. The incidental impurities may vary from casting to casting and their presence is without significant detriment to the current invention.

Particularly with castings of those Al—Si alloys, the castings may be pre-heated to a temperature in the range of 100° C. to 350° C. before step (a) so that the time required to heat into the appropriate temperature range for step (a) is minimised.

With those Al—Si alloys, the silicon plays an important role in the method of the present invention, as detailed later herein.

As indicated, a casting heat treated by the method of the present invention is subjected to solution treating for a period of less than 30 minutes in a temperature range that is 20 to 150° C. below the solidus melting temperature of the alloy of the casting. The solution treatment period within that temperature range may be less than 20 minutes and preferably not more than 15 minutes, such as from 2 to 15 minutes.

With quenching the casting into water at higher temperatures in the range between 0 and 100° C., the casting can have substantial heat energy content. In that case, the alloy may be cooled rapidly from the higher temperature, if required.

Prior to the commencement of step (a) of the method of the invention, the casting is referred to as "as cast", meaning it has been high pressure die cast in a conventional high pressure die-casting machine, without the need for a use of an applied high vacuum or a reactive gas. Prior to the commencement of step (a) the alloy can be at ambient temperature or at a higher intermediate temperature, such as 200° C.-350° C. if it is pre-heated or if it has retained some thermal energy from the casting process. During step (a), the alloy is heated into the appropriate temperature range for the appropriate time according to the current invention for the solution treatment step. Following step (b), the casting can be referred to as "solution treated" or "solution treated and quenched". Following step (c), the casting is referred to as "precipitation hardened" or "age hardened".

With the application of the heat treatments described for the present invention to HPDC's exhibiting normal porosity, there is a surprising minimisation or total absence of surface blistering. Components remain dimensionally stable and may exhibit large increases in mechanical properties.

BRIEF DESCRIPTION OF THE DRAWINGS

FIG. 1 is a micrograph taken from the head section of a cylindrical tensile sample of CA313 alloy, produced by a HPDC technique at a shot speed of 26 m/s, which refers to the velocity of the metal at the gate. A conventional cold chamber machine was used, without the use of either an applied high vacuum or a reactive gas. The micrograph shows porosity typical of many conventional HPDC's, and exhibits a range of pore sizes from just a few microns in size up to several hundred microns in size. As can be appreciated, the levels and size of porosity in a given HPDC may vary widely from casting to casting.

Figure 1:
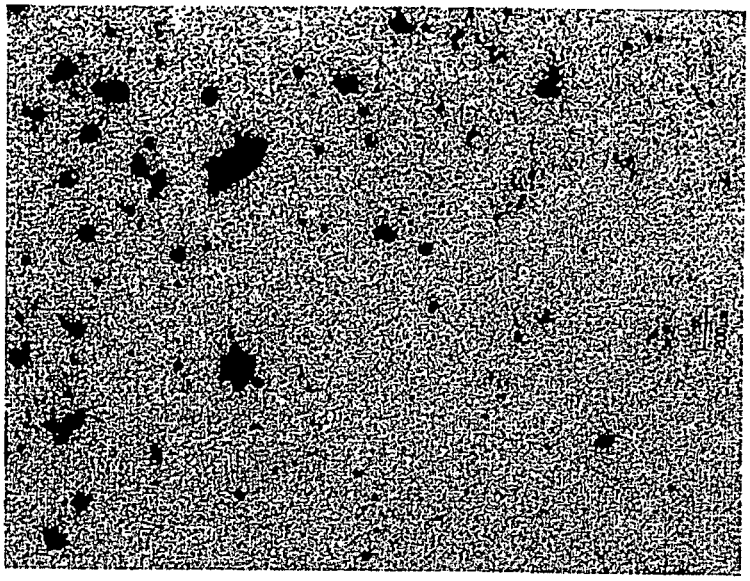
FIG. 1 is a micrograph of a cross section of a conventional high pressure diecast alloy showing porosity contained within its microstructure.
Figure 2:
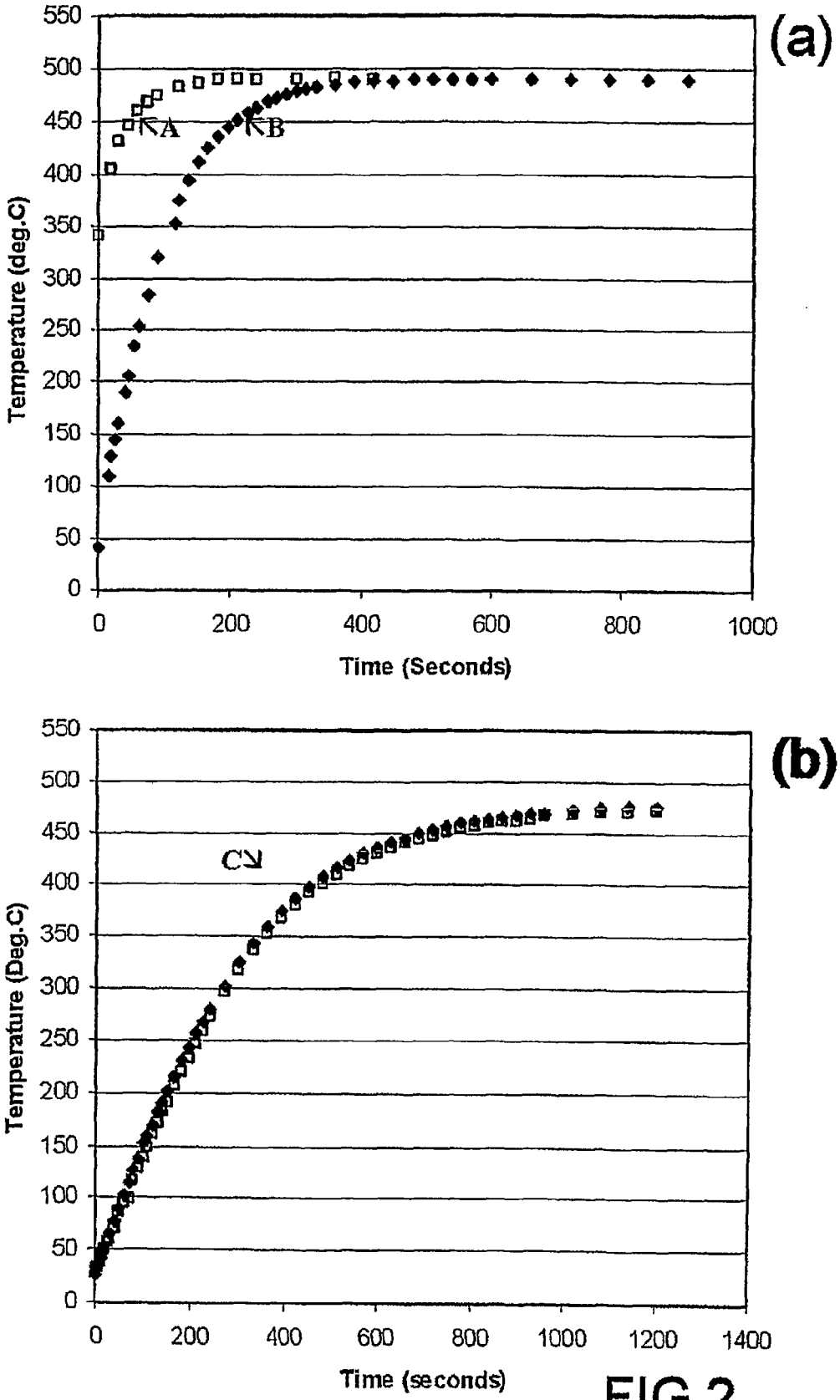
FIG. 2 shows plots of curves showing examples of solution treatment heating cycles for the present invention with use of Australian Designation alloys CA313 and CA605 age hardenable alloys.

The plots of FIG. 2 show typical solution treatment heating cycles for examples of the present invention. The plot arrowed as "A" shows the heating cycle obtained with a thermocouple placed into the furnace with no sample attached, arrowed as "A". The plot arrowed as "B" also shows the heating rate of a smaller HPDC sample of about 25 g in weight obtained with a thermocouple imbedded securely within the sample at the middle point, for a cylindrical section with a diameter of 12.2 mm. For this sample size and type, the total time of heating for the solution treatment step is 15 minutes (900 seconds). The sample was of a HPDC alloy CA313 having a solidus temperature close to 540° C. The alloy was placed into a hot furnace set at 490° C. The sample reached 390° C. in 130 seconds (about 150° C. below the solidus), and then continued to rise to its final designated temperature of 490° C. over the following 290 seconds. The total time taken to reach the set temperature was 420 seconds, or 7 minutes.

FIG. 2 also shows a plot arrowed "C", depicting the heating cycle for thermocouples imbedded securely within a larger HPDC sample at two locations, one being in a section of the sample directly in the forced air stream of the furnace and one in a sample section completely shielded from the forced air stream. The larger sample mass was 550 g, and had a maximum wall thickness of 15.2 mm. The sample was found by experimentation to display some dimensional instability and blistering at times equal to or greater than 30 minutes total furnace immersion for a furnace set temperature of 475° C., but none at 20 minutes total furnace immersion. The alloy was CA605 casting alloy, with a solidus temperature of close to 555° C. The alloy reached 395° C. in 450 seconds (7.5 minutes) of immersion into the hot furnace. The alloy continued to increase in temperature right up until 1140 seconds immersion time (19 minutes). The sample then remained at 475° C. for 60 seconds before being water quenched. In this instance, the solution treatment stage was effectively non-isothermal.

For the samples tracked in FIG. 2, each of the CA313 and CA605 alloys showed a strong age hardening response during artificial (T6) ageing following the illustrated solution treatment cycles and quenching from the solution treatment temperature and times shown.

As is apparent from FIG. 2, surprisingly, the time spent by samples in isothermal solution treatment is less important in the present invention than the time spent within the specific temperature range, and the final temperature reached prior to quenching, since much of the solution treatment process was conducted non-isothermally. As a result of being treated according to the process of the present invention, HPDC samples were blister free when subsequently age hardened by known techniques of heat treatment.

Figure 3:
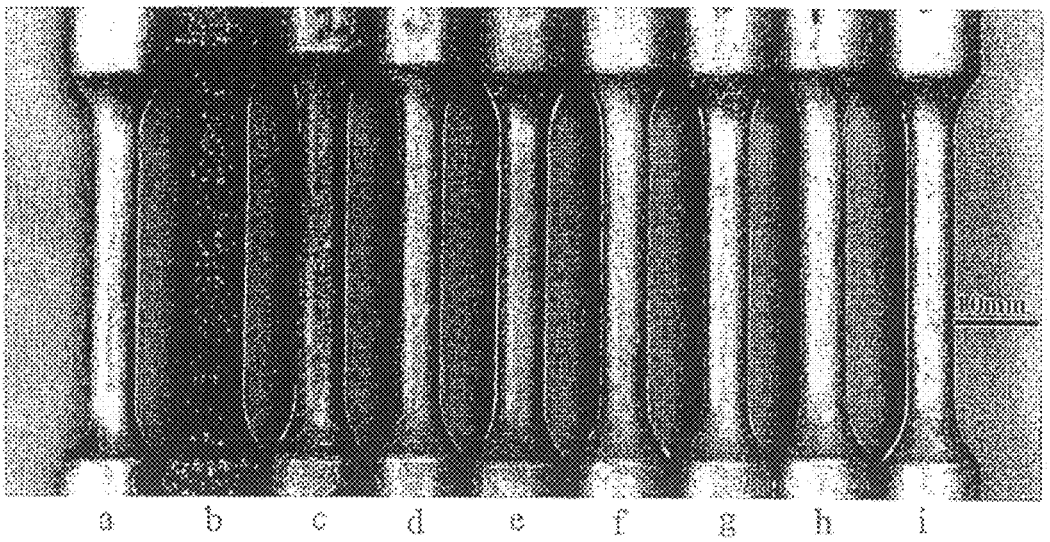
FIG. 3 is a photograph of the surface appearance of a series of nine similarly produced castings 3(a) to 3(i) of a an alloy CA605 age hardenable alloy, with casting 3(a) shown as cast and castings 3(b) to 3(i) shown after respective heat treatments.

The castings 3(a) to 3(i) shown in FIG. 3 were produced by a HPDC technique, using a conventional cold chamber machine, without any application of a vacuum or use of a reactive gas. Thus, at the commencement of each casting cycle, the die cavity was at ambient pressure and contained air which was able to be partially displaced and partially entrapped by molten alloy during die cavity fill. Thus, the castings were produced from conventional Australian Designation CA605 alloy having a nominal solidus temperature of about 555° C. and comprising (in wt %) Al-9Si, 0.7Fe-0.6Mg-0.3Cu-0.1Mn-0.2Zn— (<0.2 other elements total), under conditions which resulted in them exhibiting internal porosity. Those conditions include a slow shot velocity of about 26 m/s at the in-gate to the casting cavity.

Castings of CA605 alloy composition are considered not to be amenable to age hardening heat treatments when produced by the HPDC technique used for the castings of FIG. 3. This is because of surface blistering caused by the expansion of internal pores during solution treatment at high temperatures (eg. 525-540° C.).

The castings shown in FIG. 3 were tensile test bars having a total length of 100 mm. They had a central gauge section of 33 mm length and 5.55 mm diameter which merged through transition sections with respective head sections of 27 mm length and 12.2 mm diameter. Of the castings shown in FIG. 3, casting 3(a) is in the as cast condition, while castings 3(b) to 3(i) are shown after a respective solution treatment. The solution treatments were as set out in Table I.

TABLE I

Solution Treatment for Castings of FIG. 3

| Casting | Solution Treatment Temp. | Solution Treatment Time |
|---|---|---|
| 3(b) | 545° C. | 16 h |
| 3(c) | 545° C. | 0.25 h |
| 3(d) | 535° C. | 0.25 h |
| 3(e) | 525° C. | 0.25 h |
| 3(f) | 515° C. | 0.25 h |
| 3(g) | 505° C. | 0.25 h |
| 3(h) | 495° C. | 0.25 h |
| 3(i) | 485° C. | 0.25 h |

Casting 3(a) exhibits a quality finish characteristic of high pressure die castings of aluminium alloys. Each of castings 3(b) to 3(i) in the as cast condition, exhibited the same high quality surface finish and were chosen randomly from the same casting batch as that shown in FIG. 3(*a*). Casting 3(b), after the 16 hour solution treatment at 545° C., and about 10° C. below the nominal solidus, shows significant blistering over its entire surface. This is due to entrapped internal gaseous porosity having expanded, in this instance probably close to its maximum volume expansion at the solution treatment temperature. In addition, measurement of the sample dimensions showed a significant increase in length and width, which is characteristic of a process of high temperature creep leading to dimensional instability. In contrast to casting 3(b), casting 3(c), after solution treatment for only 15 minutes at 545° C. (including heat up to temperature) exhibited a substantially reduced level of blistering, although the level still is unacceptable and some high temperature creep has still occurred. Further improvement is shown by casting 3(d), solution treated at 535° C. for 0.25 h (including heating up to temperature), which is substantially free of any blistering; while castings 3(e) to 3(i) also are blister-free and have a surface finish comparable to that of casting 3(a). Castings 3(b) to 3(i) show that, as the casting solution treatment temperature and/or total time is reduced, the occurrence of, and tendency for formation of, blisters decreases accordingly.

Figure 4:
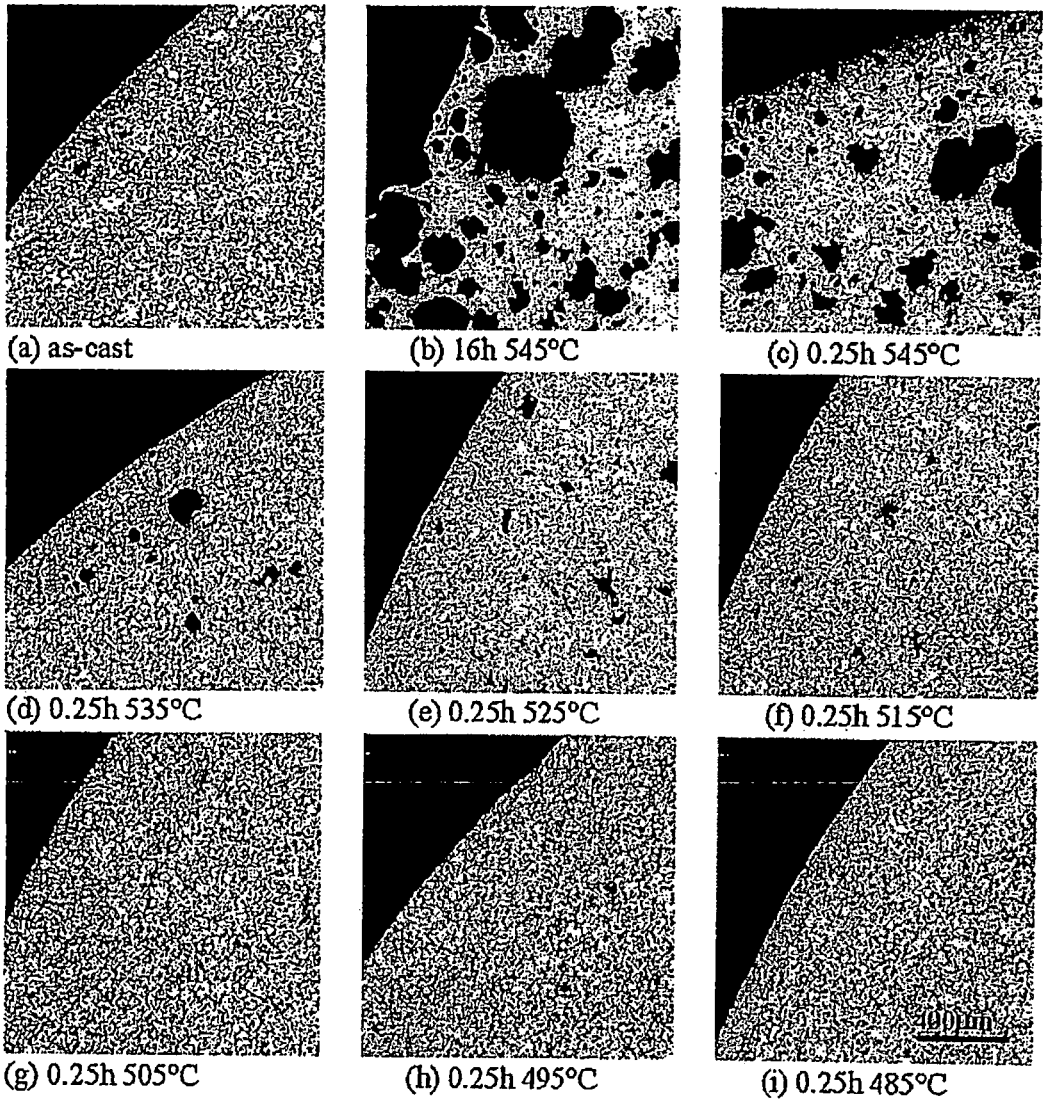
FIG. 4 is a set of micrographs 4(a) to 4(i) respectively taken from cross sections of castings 3(a) to 3(i) of FIG. 3.

FIG. 4 shows micrographs 4(a) to 4(i) of internal sections prepared from respective castings 3(a) to 3(i) of FIG. 3. These show the differences in levels of porosity for the different heat treatment conditions. FIG. 4 additionally shows the level of blistering that may result from heat treatment, and how this is able to be controlled by the present invention. FIG. 4(*a*) illustrates porosity present in the as cast alloy 3(a), which is also typical of each of castings 3(b) to 3(i) in the as cast condition prior to solution treatment. FIGS. 4(*b*) to 4(*f*) show expansion of pores that occurred as a consequence of solution treatment. In the case of FIG. 4(*b*), the expansion was extreme and resulted in extensive blistering on the surface and high temperature creep evident in casting 3(b) as shown in FIG. 3. FIG. 4(*c*) also shows substantial expansion of pores, but with this resulting in the substantially reduced level of blistering exhibited by casting 3(c), when compared to casting 3(b). FIGS. 4(*d*) to 4(*f*) show significant, but decreasing levels of pore expansion, which has been insufficient to cause significant blistering, as shown by castings 3(d) to 3(f). FIGS. 4(*g*) to 4(*i*) show little if any discernable pore expansion, consistent with the high quality, blister free castings 3(g) to 3(i).

Figure 5:
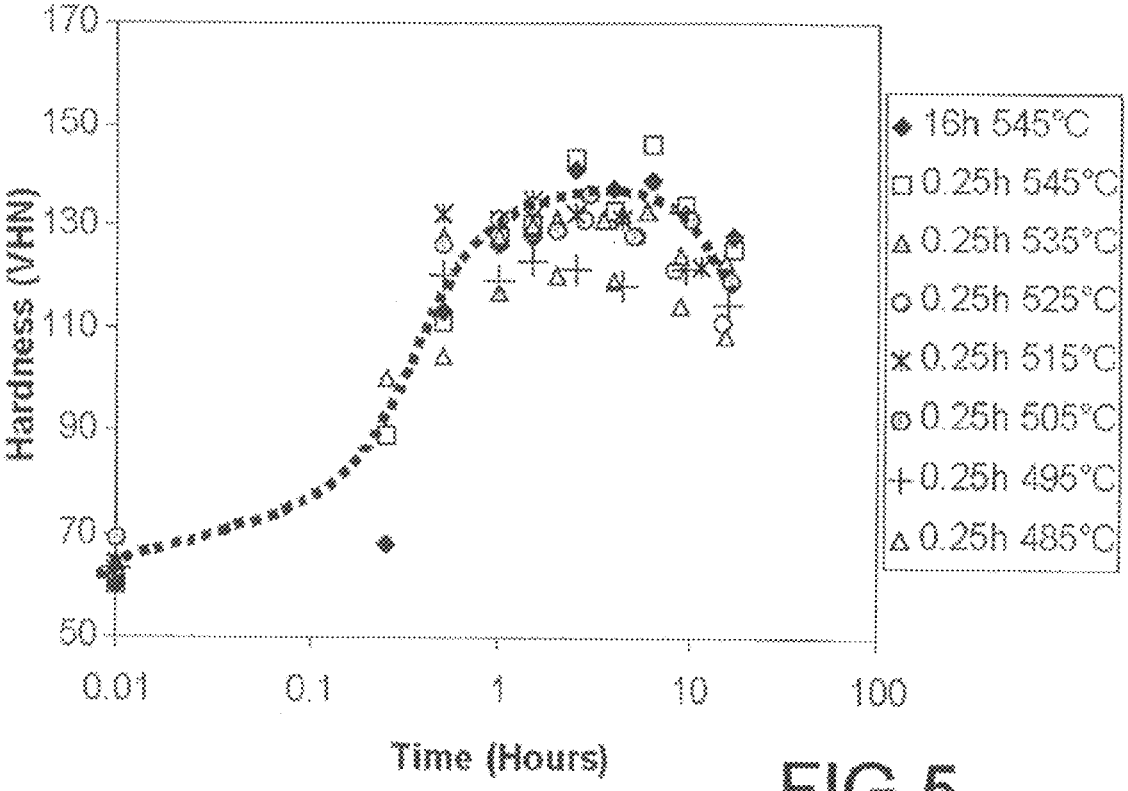
FIG. 5 shows a plot of hardness against artificial ageing time at 180° C. for castings 3(b) to 3(i) of FIG. 3, after the respective solution treatments and ageing.

FIG. 5 shows the respective responses of alloy CA605 to precipitation hardening for each of castings 3(b) to 3(i) of FIG. 3, when aged at 180° C. following solution treatment. The points plotted in FIG. 5 for each of castings 3(b) to 3(i) is distinguished in accordance with the legend shown to the right of FIG. 5 in descending order from 3(b) shown as solid diamonds and 16 h at 545° C. to 3(i) shown as outlined triangles and 0.25 h at 485° C. As shown by FIG. 5 for castings 3(b) to 3(g), the kinetics of ageing for attaining peak hardness is not altered between the upper solution treatment temperature of 545° C. and the lower limit of 505° C. The broken line shown in FIG. 5 is a general trend line for data from each of castings 3(b) to 3(g). Below 505° C. the rates of ageing are slightly reduced for castings 3(h) and 3(i). However, the hardness values obtained with age-hardening of the alloy of castings 3(h) and 3(i) still were surprisingly high, particularly given the low temperature and short period of the respective solution treatments for castings 3(h) and 3(i).

Figure 6:
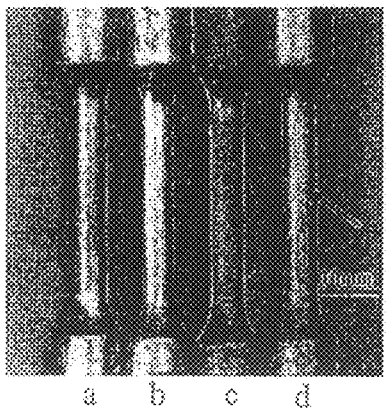
FIG. 6 is a photograph of a second series of four similarly produced castings 6(a) to 6(d) of the alloy shown in FIG. 3, with casting 6(a) shown as cast and castings 6(b) to 6(d) shown after respective increasing times at a common solution treatment temperature.

FIG. 6 shows four castings 6(a) to 6(d) which were produced in the same way, using the same alloy CA605 and specimen dimensions, as the castings shown in FIG. 3. Casting 6(a) is in the as cast or non-heat-treated condition, while castings 6(b) to 6(d) were solution treated for 5, 15 and 20 minutes, respectively, at 515° C. FIG. 6 shows the surfaces of the castings from which it is evident that blistering commenced at about 20 minutes, arrowed for casting 6(d), but not at 15 minutes.

Figure 7:
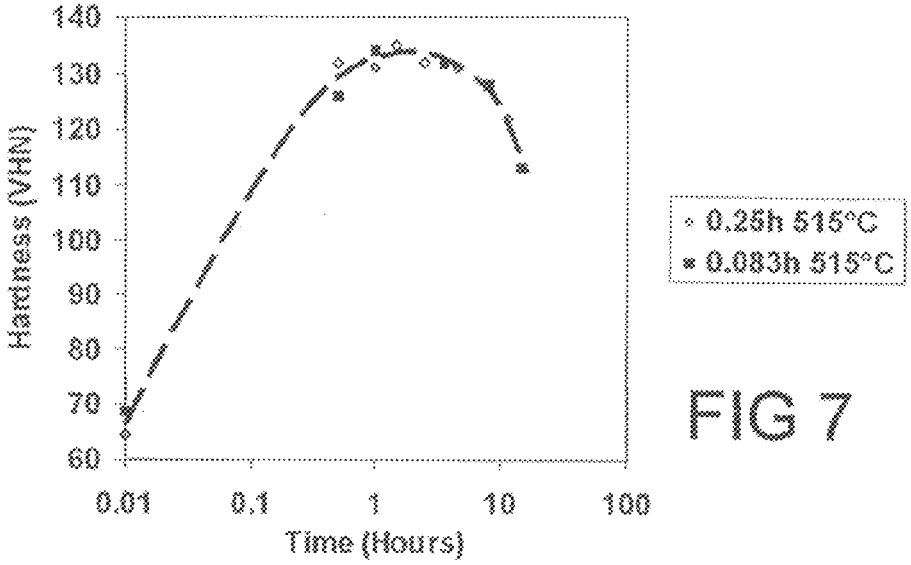
FIG. 7 shows a plot of hardness against age hardening time at 180° C. for castings 6(b) and 6(c) of FIG. 6.

FIG. 7 shows the responses of alloy CA605 to age hardening for each of castings 6(b) and 6(c) when solution treated for 5 and 15 minutes at 515° C. It can be noted from FIG. 7, that there are no differences in hardening kinetics or peak hardness between the alloy of castings 6(b) and 6(c).

Table II summarises the tensile properties of CA605 alloy in castings that were prepared by conventional HPDC techniques, without application of a vacuum or use of a reactive gas and containing typical porosity levels, and then subjected to various heat treatments. For the castings, a slow shot velocity of 26 m/s, a high shot velocity of 82 m/s or a very high shot velocity of 123 m/s were used where these speeds were the velocity of the metal at the in-gate.

TABLE II

Properties of alloy CA605 in HPDC Castings

| Sample | Casting Technique | Quenched from casting (Y/N) | Solution treatment | Ageing | 0.2% proof stress | Tensile strength | Elongation |
|---|---|---|---|---|---|---|---|
| A | As HPDC | N | N/A | N/A | 162 MPa | 253 MPa | 2% |
| B | HPDC | N | 515° C. 15 minutes then CWQ | T6: 180° C. 2 h | 302 MPa | 326 MPa | 1% |
| C | HPDC | Y | 515° C. 15 minutes then CWQ | T6: 180° C. 2 h | 296 MPa | 311 MPa | 1% |
| C | HPDC | Y | 525° C. 15 minutes then CWQ | T6: 180° C. 2 h | 296 MPa | 308 MPa | 1% |
| E | High speed HPDC | Y | N/A | N/A | 178 MPa | 310 MPa | 3.5% |
| F | High speed HPDC | Y | 525° C. 15 minutes then CWQ | T6: 180° C 2 h | 320 MPa | 373 MPa | 2.5% |
| G | High speed HPDC | Y | 515° C. 15 minutes then CWQ | T4 (2 weeks at 25° C.) | 180 MPa | 310 MPa | 6% |

TABLE II-continued

| Properties of alloy CA605 in HPDC Castings | | | | | | | |
|---|---|---|---|---|---|---|---|
| Sample | Casting Technique | Quenched from casting (Y/N) | Solution treatment | Ageing | 0.2% proof stress | Tensile strength | Elongation |
| H | High speed HPDC | Y | 515° C. 15 minutes then CWQ | T6I4 (0.5 h 180° C., 4 weeks 65° C.) | 313 MPa | 387 MPa | 3.4% |
| I | Very High Speed HPDC | N | 515° C. 15 minutes then CWQ | T6: 180° C. 2 h | 333 MPa | 404 MPa | 3% |

In Table II, abbreviations have the following meanings:

(1) "HPDC" for samples A to D designates casting by the conventional technique described above in respect of the castings of each of FIGS. 3 and 4, and using a slow shot velocity of 26 m/s at the in-gate;

(2) "High Speed HPDC" for Samples E to H and "Very High Speed HPDC" for Sample I designates shot velocities (at the in-gate) of 82 m/s and 123 m/s, respectively.

(3) "CWQ" denotes a cold water quench.

(4) "T6I4" as the designation of the ageing for Sample H indicates ageing in accordance with the disclosure of International patent application WO02070770 by Lumley et al in which artificial ageing of an alloy at the initial temperature is arrested by quenching after a relatively short period, after which the alloy is held at temperature and for a time sufficient to allow secondary ageing to occur.

As shown by Table II, the tensile properties obtainable by using the present invention reveal the highly beneficial effect of age hardening. The property levels do not reflect any significant compromise when compared with conventional ageing treatments, and yet they have been obtained with castings produced by conventional HPDC without the heat treated castings exhibiting blistering. Table II also indicates that there is no benefit to the current invention in quenching from the casting process, before solution treatment, quenching and ageing according to the present invention.

Figure 8:
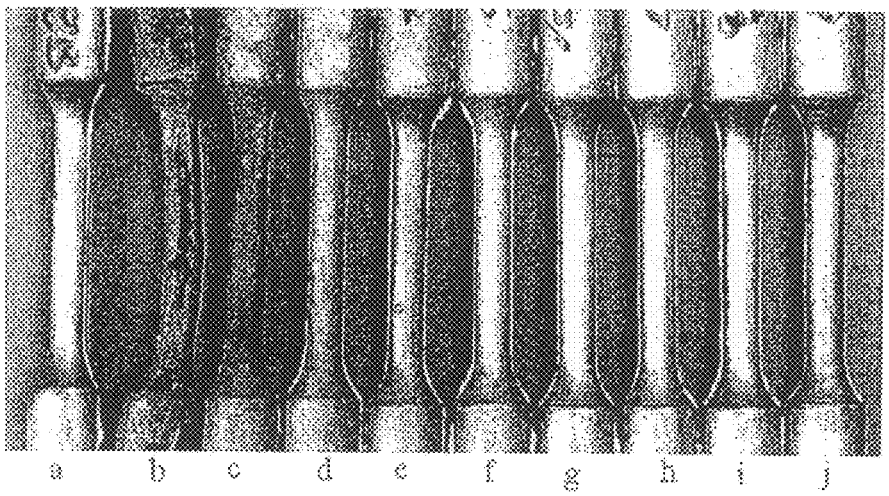
FIG. 8 is a photograph of a series of ten similarly produced castings 8(a) to 8(j) of CA313 age-hardenable HPDC aluminium alloy, with casting 8(a) shown as cast and castings 8(b) to 8(j) shown after respective solution treatments.

FIG. 8 shows castings 8(a) to 8(j) which were produced in the same way and to the same form and dimensions as the castings shown in FIG. 3. However, the castings shown in FIG. 8 were produced from a conventional Australian Designation CA313 alloy having a normal solidus temperature of 538° C. and found to contain (in wt %) Al-8.8Si-3Cu-0.86Fe-0.59Zn-0.22Mg-0.2Mn-(<0.15 total Pb, Ni, Ti, Sn, Cr,)

Castings of this CA313 alloy also are not considered to be amenable to heat treatment when produced by the conventional HPDC casting technique used for castings 8(a) to 8(j), again due to the incidence of surface blistering and loss of dimensional stability.

The castings shown in FIG. 8 differ in that casting 8(a) is in the as cast condition, while castings 8(b) to 8(j) were solution treated for 15 minutes total immersion time under various conditions shown in Table III.

TABLE III

| Solution Treatments for Castings of FIG. 8 | |
|---|---|
| Casting | Solution Temp |
| 8(b) | 530° C. |
| 8(c) | 520° C. |

TABLE III-continued

| Solution Treatments for Castings of FIG. 8 | |
|---|---|
| Casting | Solution Temp |
| 8(d) | 510° C. |
| 8(e) | 500° C. |
| 8(f) | 490° C. |
| 8(g) | 480° C. |
| 8(h) | 470° C. |
| 8(i) | 460° C. |
| 8(j) | 440° C. |

Casting 8(b) exhibits dimensional instability due to the solution temperature being slightly too close to the solidus, although there is little if any evidence of such instability in casting 8(c) at the next lower solution temperature, or in other castings. However, each of castings 8(b) and 8(c) exhibit unacceptable blistering. Both castings 8(d) and 8(e) show one large blister and several smaller ones, indicating an unacceptable reject rate, whereas castings 8(f) to 8(j) show good finish quality following solution treatment and no evidence of blistering.

A comparison between castings 8(b) to 8(j) on the one hand and castings 3(c) to 3(i) of FIG. 3 on the other shows a difference between the responses of the respective CA313 and CA605 alloys. This is that CA313 tends to necessitate using a lower solution temperature for a given solution treatment time, or a shorter treatment time at a given temperature, relative to the time and temperature relationships for solution treatment of CA605 alloy. This contrast highlights the need to control solution treatment temperature so that it is within the range of 20° C.-150° C. lower than the solidus temperature and to use times less than 30 minutes in that temperature range when heat treating HPDC aluminium alloys.

Figure 9:
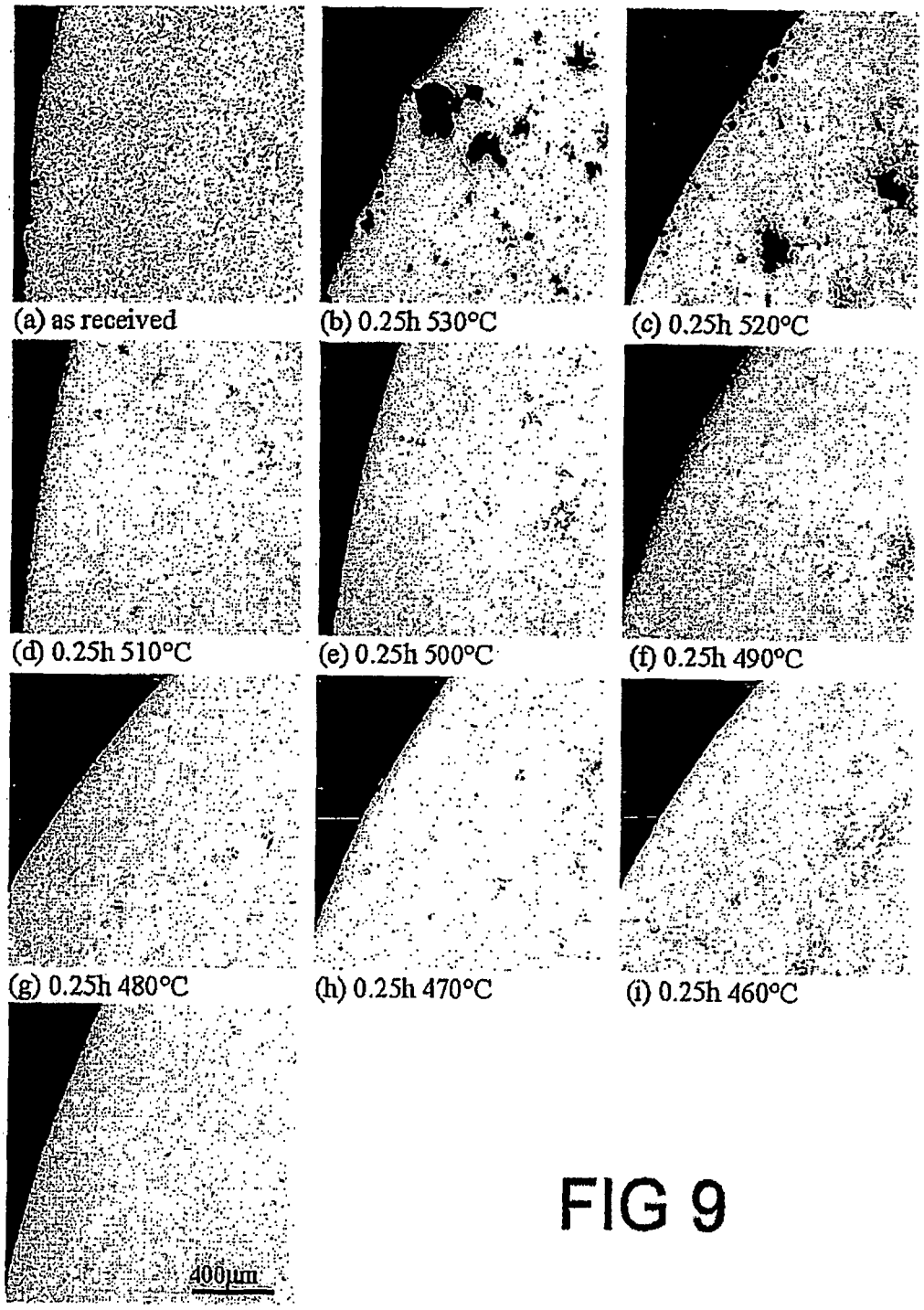
FIG. 9 is a set of micrographs 9(a) to 9(j) respectively taken from cross sections of castings 8(a) to 8(j) of FIG. 8.

FIG. 9 shows the optical microstructures, in micrographs 9(a) to 9(j), of the alloy of castings 8(a) to 8(i), respectively, of FIG. 8. As such, FIG. 9 provides a showing similar to FIG. 4, but in respect of castings of CA313 alloy. Thus, FIG. 9(*a*) shows porosity present in the alloy of the as cast casting 8(a). FIGS. 9(*b*) and 9(*c*) show blistering which has resulted from pore expansion during the solution treatments for castings 8(b) and 8(c), respectively. FIGS. 9(*d*) to 9(*e*) illustrate the substantial avoidance of pore expansion and, hence, limited blistering from the solution treatments for castings 8(d) and 8(e), while FIGS. 9(*f*) to 9(*j*) show the substantially complete avoidance of pore expansion and of blistering with the solution treatments for castings 8(f) to 8(j), respectively.

Figure 10:
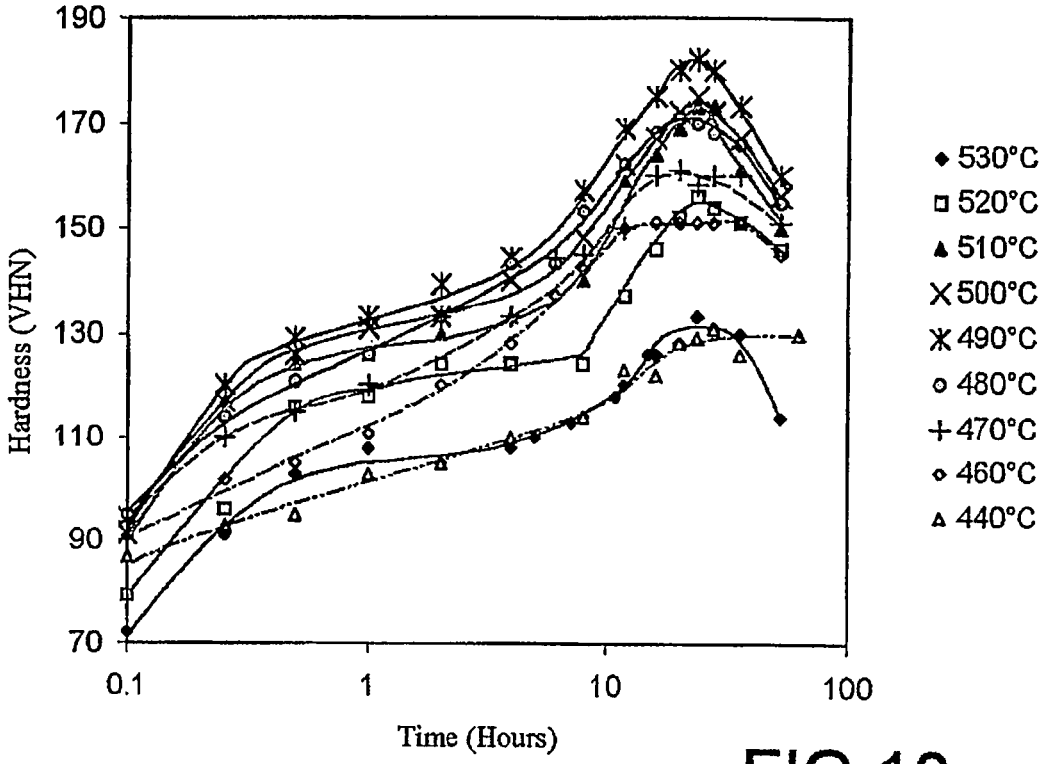
FIG. 10 shows a plot of hardness against artificial ageing time at 150° C. for the alloy of castings 8(b) to 8(j) of FIG. 8, after the respective solution treatments for those castings.

FIG. 10 shows the precipitation hardening behaviour of the CA313 alloy of each of castings 8(b) to 8(j) of FIG. 8, following ageing at 150° C. after the respective solution treatment conditions described with reference to FIG. 8. In difference to the kinetics of ageing shown in FIG. 5 for alloy CA605, FIG. 10 shows that for CA313 alloy the rate of ageing and the peak hardness continue to increase as the solution treatment temperature is decreased to a level of about 490° C. to 480° C., but then to decrease sequentially again as the solution treatment temperature falls below that level. Each curve can be related to the respective casting by the solution treatment temperatures shown in the legend to the right of FIG. 10. Surprisingly, even the alloy solution treated at temperature as low as 440° C. exhibited a useful age hardening response.

Figure 11:
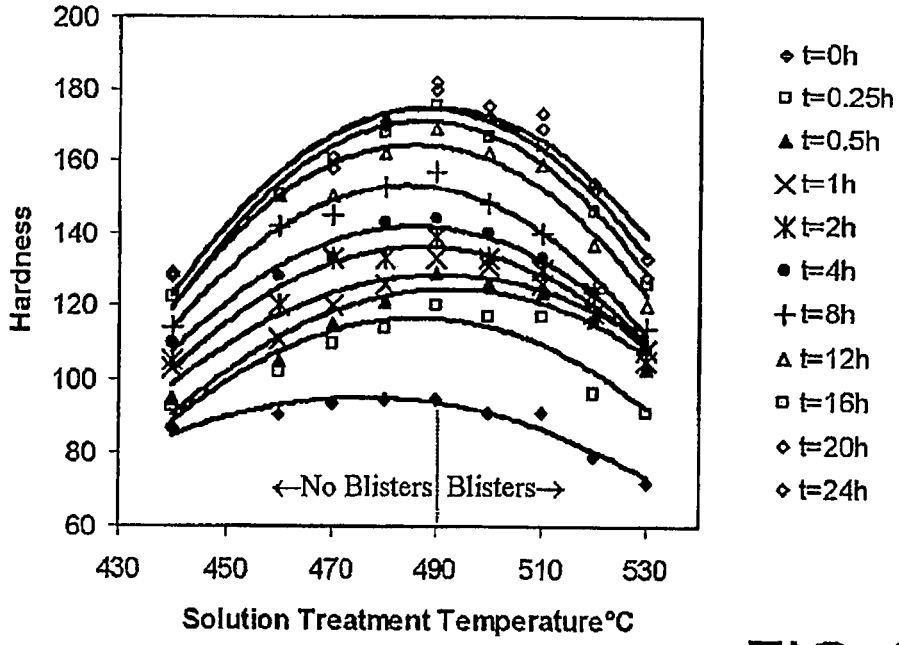
FIG. 11 is a plot showing the same data as FIG. 10, up to 24 h ageing at 150° C., in which the respective curves for castings 8(b) to 8(j) of FIG. 8 show increments in hardness as a function of time at the ageing temperature.

FIG. 11 shows the same precipitation hardening data as for FIG. 10, up to 24 h ageing. The plots show the increase in hardness as a function of time at 150° C. for each of the different solution treatment temperatures for castings 8(b) to 8(j). The symbols of FIG. 11 correspond to those of FIG. 10.

Figure 12:
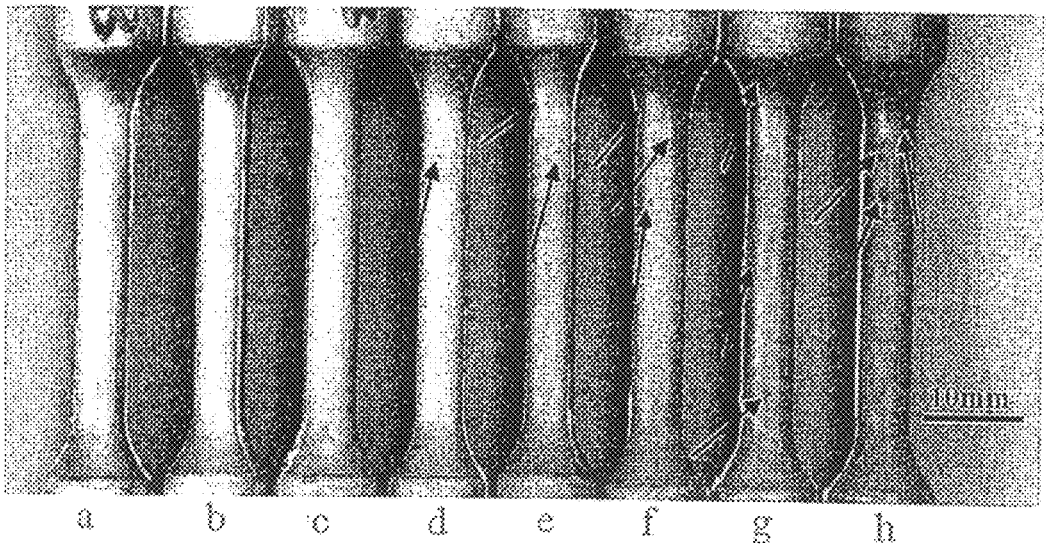
FIG. 12 is a photograph of a series of eight castings 12(a) to 12(h), similarly produced to those shown in FIG. 8*a* and of the CA313 alloy, with casting 12(a) shown as-cast and castings 12(b) to 12(h) shown after respective solution treatment times at a common solution treatment temperature.

FIG. 12 shows the effect of solution treatment time at 490° C. for the CA313 alloy of a series of eight castings 12(a) to 12(h). Each of the castings of the series was produced by the same HPDC technique and to the same form and dimensions as the castings shown in FIG. 3. Casting 12(a) is in the as cast condition, while the time at 490° C. for the other castings is shown in Table IV. FIG. 12 therefore shows the evolution of blisters as a function of hold time at 490° C.

TABLE IV

Solution Treatments for Castings of FIG. 12

| Casting | Solution Time |
|---|---|
| 12(b) | 10 min |
| 12(c) | 15 min |
| 12(d) | 20 min |
| 12(e) | 30 min |
| 12(f) | 40 min |
| 12(g) | 60 min |
| 12(h) | 120 min |

The arrows shown for castings 12(d) to 12(h) point to blisters that have formed on the surfaces of those castings. As the solution treatment time is increased, beginning at about 20 minutes, the prevalence of blisters increases from a few on casting 12(d) up to a larger number at the longer time of 120 minutes.

Figure 13:
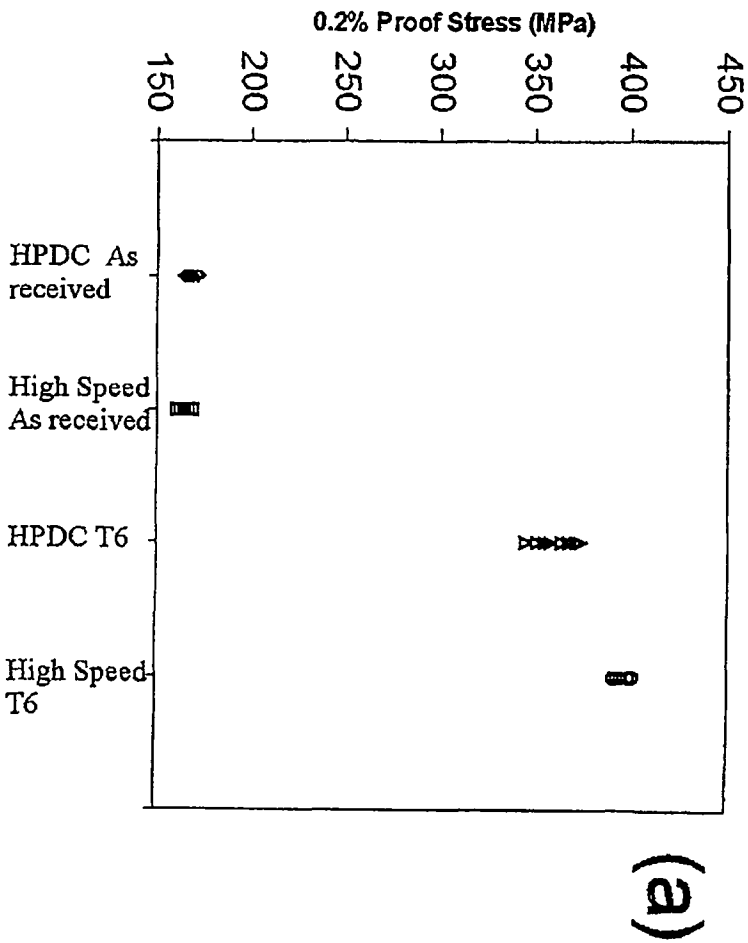
FIG. 13 shows the scatter in tensile properties for the castings corresponding to the casting 12(c), produced by either slow or high shot speed high pressure diecasting.
Figure 13:
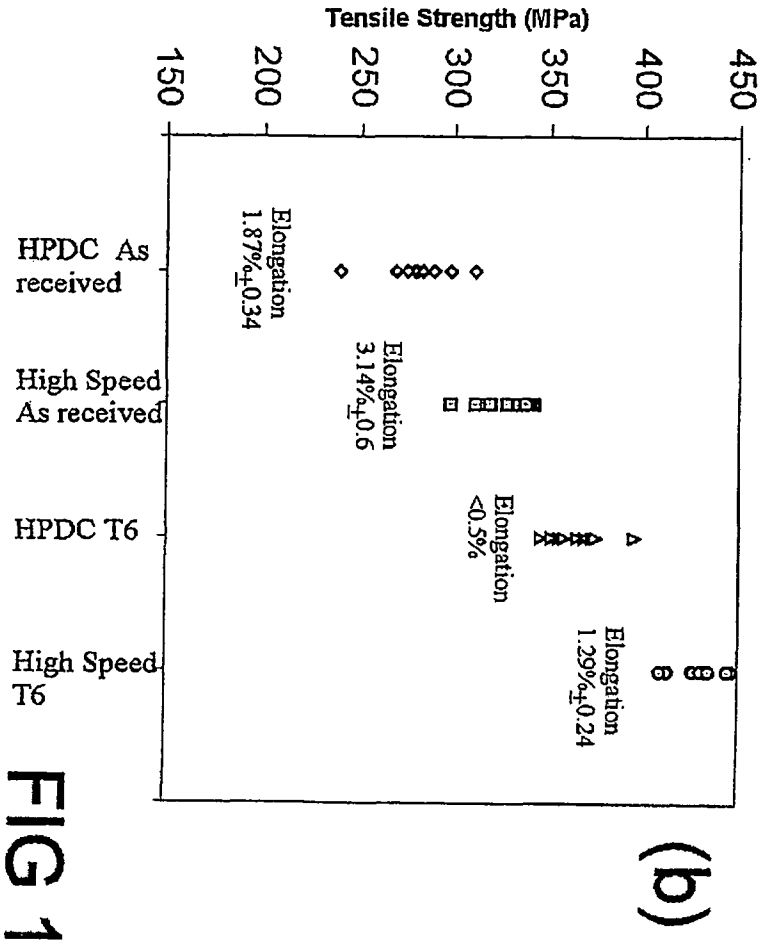

FIG. 13 shows the scatter in tensile properties for as received and heat treated CA313 alloy, where either a slow (26 m/s) or high shot velocity (82 m/s) in-gate velocity was used. In this, "HPDC" has the same meaning as indicated above for Table II, while "High Speed" has the same meaning as "High Speed HPDC" in Table II.

Table V shows the tensile properties of the HPDC CA313 alloy prepared to either T6, T4, T6I4 or T6I7 conditions. Each alloy was solution treated at a maximum temperature of 490° C. for 15 minutes (including time of heating up to temperature), cold water quenched and then aged. Artificial ageing for the T6 temper was conducted at 150° C. For the T4 temper, the alloy was solution treated as above, then exposed at ~22° C. for a period of 14 days.

TABLE V

Properties of Heat Treated CA313 alloy

| Condition | Temper | 0.2% proof stress | Tensile Strength | Elongation % |
|---|---|---|---|---|
| Conventional HPDC | As Cast | 167 MPa | 281 MPa | 2% |
| | T4 | 238 MPa | 314 MPa | 2% |

TABLE V-continued

Properties of Heat Treated CA313 alloy

| Condition | Temper | 0.2% proof stress | Tensile Strength | Elongation % |
|---|---|---|---|---|
| 26 m/s | T6 | 363 MPa | 366 MPa | 1% |
| | T6I4 | 287 MPa | 339 MPa | 1% |
| | T6I7#1 | 229 MPa | 300 MPa | 2% |
| | T6I7#2 | 267 MPa | 324 MPa | 1% |
| High Speed HPDC (82 m/s) | As Cast | 164 MPa | 326 MPa | 3% |
| | T4 | 250 MPa | 382 MPa | 4% |
| | T6 | 394 MPa | 428 MPa | 1% |
| | T6I4 | 297 MPa | 409 MPa | 3% |
| | T6I7#1 | 236 MPa | 367 MPa | 4% |
| | T6I7#2 | 273 MPa | 362 MPa | 2% |
| Very High Speed HPDC (123 m/s) | As Cast | 172 MPa | 341 MPa | 4% |
| | T6 | 396 MPa | 425 MPa | 1% |

For the T6I7 conditions, represented are samples that have been underaged 2 or 4 hours, and then slowly cooled in oil at approximately 4° C./min. to suppress subsequent secondary precipitation. T6I4 tempers have been designed to retain elongation, rather than to gain equivalent to T6 tensile properties as in the example shown in Table 1. These were artificially aged 2 hours at 150° C., quenched, then exposed at 65° C. for 4 weeks. The alloy samples were from castings of the same form and dimensions as the castings shown in FIG. 3.

Table VI shows the tensile properties of a conventional CA313 HPDC alloy, recorded for further castings of the form and dimensions for the castings of FIG. 3, solution treated either 15 minutes or 120 minutes prior to quenching and precipitation hardening. Table VI shows the mechanical property benefits of utilizing a short solution treatment time compared to a conventional solution treatment time. Samples having undergone the longer solution treatment time of 120 minutes prior to precipitation hardening were selected from a larger batch of samples as those not displaying substantial blistering on the gauge length, although as is shown in the example of FIG. 12, surface blisters were still evident in this condition. Table VI shows that in addition to exhibiting surface blistering, the mechanical properties in the 120 minute condition were reduced compared to the samples processed according to the current invention.

TABLE VI

Tensile Property Differences for Different Solution Treatment Times at 490° C.

| Condition | Solution treatment time | 0.2% proof stress | Tensile strength | Elongation % |
|---|---|---|---|---|
| T6, solution treat 490° C. | 15 minutes | 394 MPa | 428 MPa | 1.3% |
| T6, solution treat 490° C. | 120 minutes | 362 MPa | 389 MPa | 1% |

Table VII shows tensile property data for alloy CA313 which was HPDC, without application of a vacuum or use of a reactive gas and containing typical porosity levels, to produce both cylindrical and smaller, flat specimens in order to examine possible effects of specimen sizes arising from age hardening treatments. The cylindrical test specimens included for comparison are the same size and dimension as those shown in FIG. 3.

TABLE VII

Effect of Specimen Size and Solution Treatment Temperature

| Condition | Solution treatment temperature | Surface condition | 0.2% Proof Stress | Tensile Strength | Elongation |
|---|---|---|---|---|---|
| Cylindrical test bars, slow HPDC - As Cast✧ | N/A | Excellent | 167 MPa | 281 MPa | 2% |
| Cylindrical test bars, fast HPDC - As Cast✧ | N/A | Excellent | 164 MPa | 326 MPa | 3% |
| Cylindrical test bars, slow HPDC - T6✧ | 490° C. | Good | 363 MPa | 366 MPa | 1% |
| Cylindrical test bars, fast HPDC - T6✧ | 490° C. | Excellent | 394 MPa | 428 MPa | 1% |
| Flat test bars, slow HPDC - As Cast | N/A | Excellent | 182 MPa | 277 MPa | 2% |
| Flat test bars, slow HPDC - T6 | 490° C. | Some blisters | 368 MPa | 385 MPa | 1% |
| | 480° C. | Good | 371 MPa | 401 MPa | 1% |
| | 470° C. | Excellent | 347 MPa | 362 MPa | 1% |
| | 460° C. | Excellent | 335 MPa | 359 MPa | 1% |
| | 440° C. | Excellent | 283 MPa | 338 MPa | 1.5% |
| Flat test bars, fast HPDC - As Cast | N/A | Excellent | 187 MPa | 320 MPa | 2.5% |
| Flat test bars, fast HPDC - T6 | 490° C. | Excellent | 392 MPa | 432 MPa | 1.5% |
| | 480° C. | Excellent | 394 MPa | 442 MPa | 2% |
| | 470° C. | Excellent | 372 MPa | 418 MPa | 1.5% |
| | 460° C. | Excellent | 341 MPa | 405 MPa | 2% |
| | 440° C. | Excellent | 285 MPa | 362 MPa | 2% |

Figure 14:
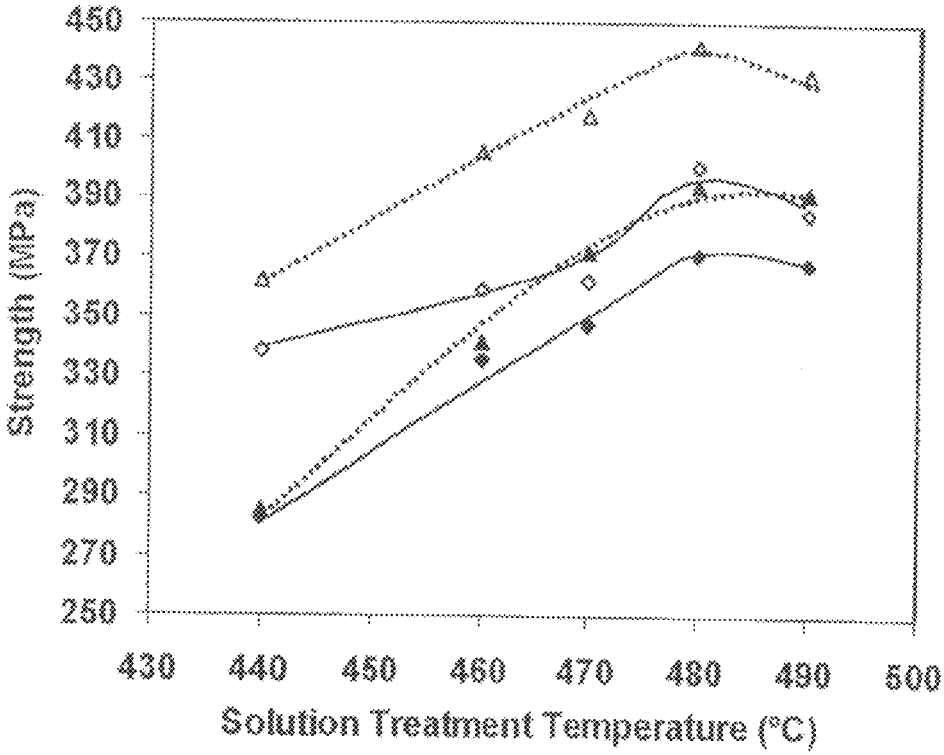
FIG. 14 is a plot of strength following heat treatment against solution treatment temperature for a further series of castings of the CA313 alloy in the age hardened condition.

These specific flat castings had dimensions of 70 mm long, and 3 mm thick with a head width of 14 mm, head length of 13 mm, parallel gauge length of 30 mm, and a gauge width of ~5.65 mm. The castings were prepared by conventional HPDC at slow shot in-gate velocities of 26 m/s and fast in-gate shot velocities of 82 m/s. The terminology of "slow" and "fast" in Table VII is the same as in Table II. Solution treatment temperatures ranging from 490° C. down to 440° C. were examined for both the slow speed and high speed high pressure die-castings. Five or more specimens were tested in every condition and the total immersion time for solution treatment was 15 minutes. The surface quality was also noted, as this was found to differ slightly from the cylindrical tensile bars examined. However, the tensile results showed a good correlation between the different specimen dimensions. The results of Table VII are summarized in FIG. 14. In FIG. 14 closed diamonds show slow speed HPDC 0.2% proof stress, open diamonds show slow speed HPDC tensile strength, closed triangles show high speed HPDC 0.2% proof stress, open triangles show high speed HPDC tensile strength. FIG. 14 suggests that the optimum solution treatment temperature for these altered dimensions of CA313 alloy is 480° C., as it displays a slightly higher tensile strength and elongation than for alloy solution treated at 490° C.

Figure 15:
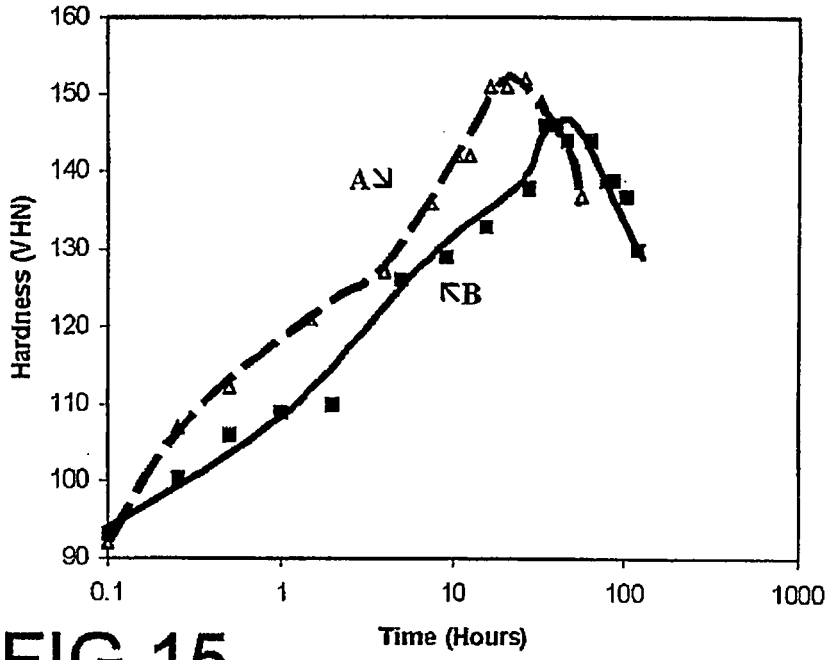
FIG. 15 is a plot of the age hardening response for the commercial alloy, CA313 in which ageing is compared between a HPDC sample and an ingot sample of the same alloy for identical solution treatment times.

FIG. 15 compares the process of the current invention for HPDC casting "A" to a section of gravity mould casting "B" each of the same CA313 alloy composition. The alloy was of the composition Al-9Si-3.1Cu-0.86Fe-0.53Zn-0.16Mn-0.11 Ni-0.1 Mg-(<0.1 Pb, Ti, Sn, Cr).

Suprisingly, the CA313 alloy of the HPDC casting both hardens faster and to higher levels than the same alloy of the gravity casting. Both castings were given a total time of immersion in a furnace pre-heated to 490° C. of 15 minutes. FIG. 15 shows that although the process of the present invention is in a sense suitable for heat treatment of an alloy produced by a different casting technique, the ageing response is substantially improved for the HPDC casting where the time of furnace immersion is the same.

Figure 16:
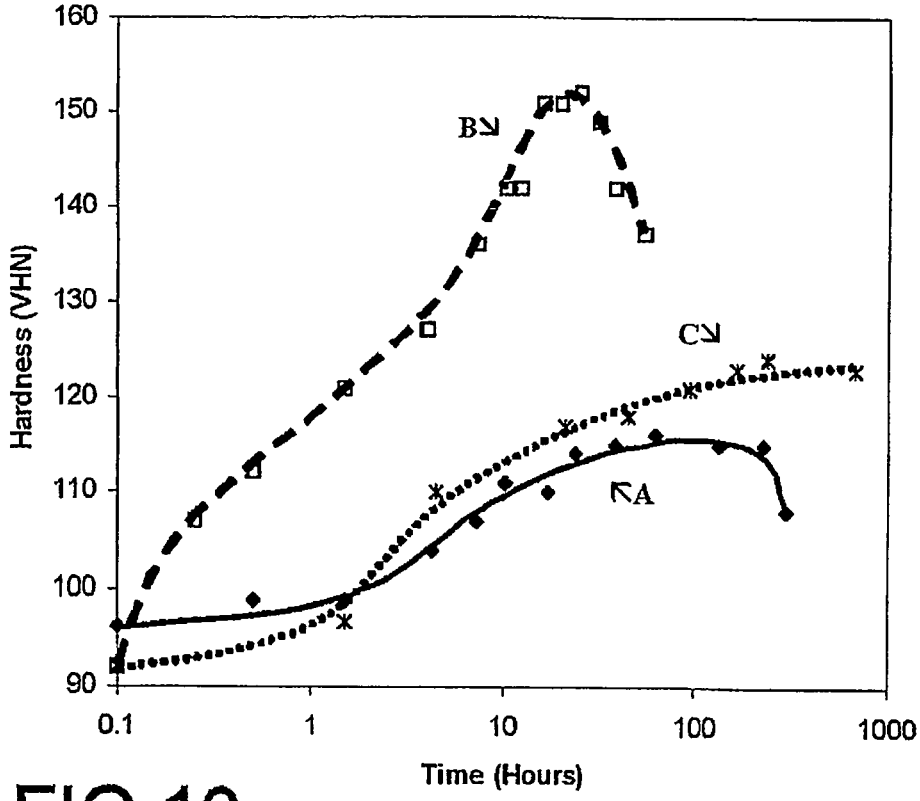
FIG. 16 is a plot of the age hardening response for the alloy CA313 in which ageing is conducted either without a discrete solution treatment step (T5 temper) or with a discrete solution treatment step before a T4 temper or a T6 temper according to the present invention.

FIG. 16 provides ageing curves under three different conditions for the CA313 alloy used for FIG. 15. "A" is for a T5 temper, which is a conventional known procedure, employed to avoid blistering in HPDC alloys and enhance strength. For a T5 temper, the as-cast alloy is heat treated directly following casting. For ageing in this condition, the alloy reaches a peak hardness of about 115VHN in 80-100 h of ageing at 150° C.

"B" in FIG. 16 is an example of a T6 temper where the process of the present invention was employed. The alloy was given a total solution treatment immersion time of 15 minutes including heat up to a solution treatment temperature of 490° C., before cold water quenching and artificially ageing at 150° C. Peak hardness of about 153VHN is reached in about 16-24 h.

"C" in FIG. 16 is for a T4 temper according to the process of the present invention. The alloy was solution treated identically to sample "B", before cold water quenching and naturally ageing at 22° C. The alloy reaches close to peak hardness of about 120-124VHN after about 100 h of ageing at 22° C., after which the hardness is little changed for longer durations.

In an alternative to, or a combination of, the processes of "B" and "C" shown in FIG. 16, a sample of the alloy given a full T4 temper was subsequently artificially aged at 150° C. for 24 h. The final hardness after this procedure was 148VHN. In this case, the alloy was solution treated, naturally aged at 22° C. for 860 h and then artificially aged at 150° C. That is, if required, a T4 tempered alloy can be further strengthened by subsequent artificial ageing.

Figure 17:
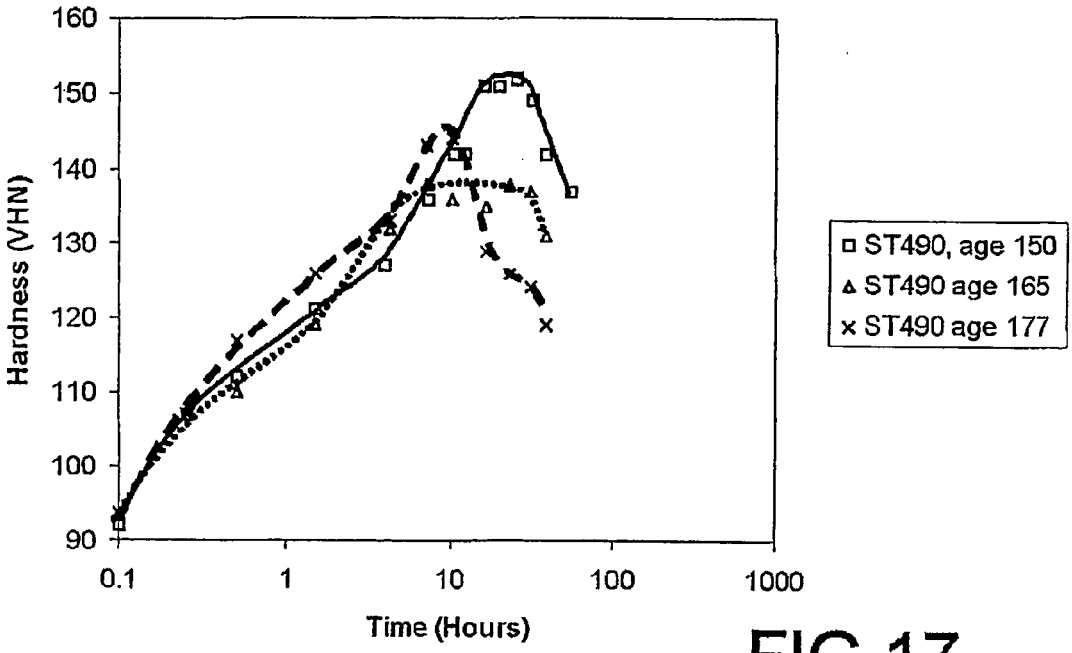
FIG. 17 is a plot of the age hardening response for the commercial alloy, CA313 wherein ageing following solution treatment is conducted at respective temperatures.

FIG. 17 shows the precipitation hardening response for CA313 alloy solution treated by a total immersion time of 15 minutes in a furnace set at 490° C., and subsequently precipitation hardened at 150° C., 165° C. and 177° C. Although the response to heat treatment is different in each instance, all alloys show characteristic strong capacity for precipitation hardening.

Figure 18:
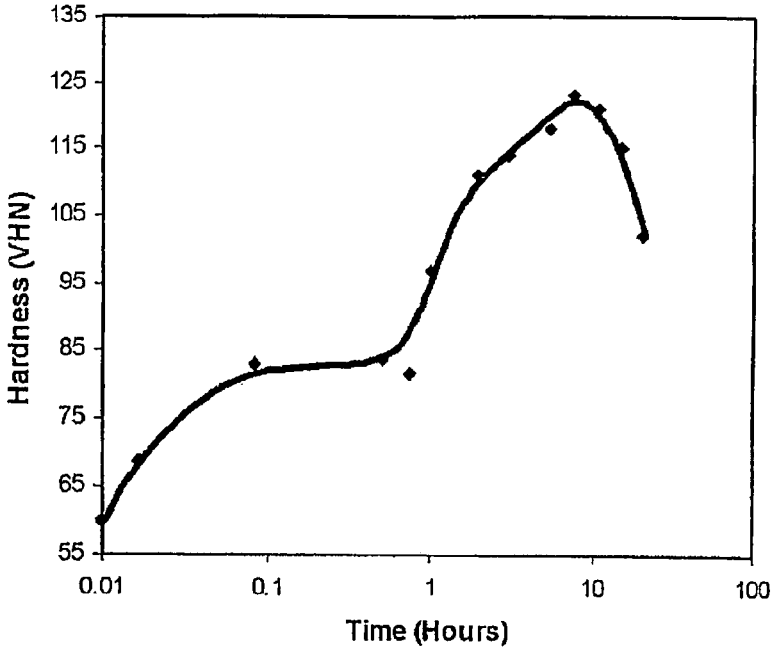
FIG. 18 is a plot of the age hardening response for a further age hardenable aluminium alloy produced by HPDC.

FIG. 18 shows the precipitation hardening response for an alloy with a composition of Al-9.2Si-1.66Cu-0.83Fe-0.72Zn-0.14Mn-0.11 Mg— (<0.1 Ni,Cr,Ca) and having a solidus temperature of ~574° C., solution treated for a total immersion time of 15 minutes at 500° C., cold water quenched and aged at 177° C. For this alloy composition, containing a reduced copper content compared to the CA313 alloy used for FIGS. 15 and 16, the age hardening process is still effective within the process window selected.

Figure 19:
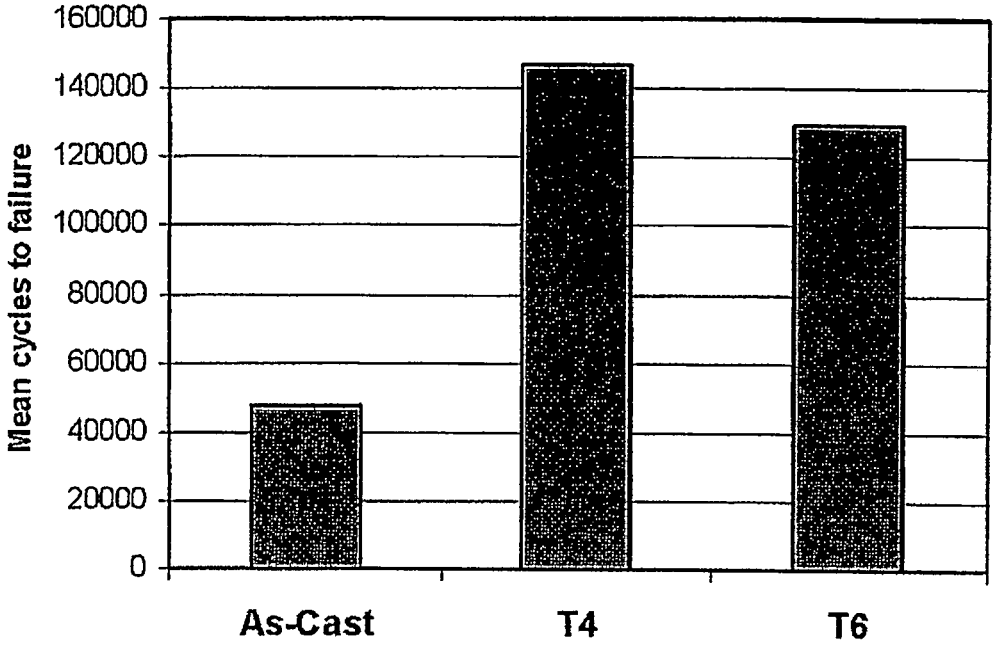
FIG. 19 is a plot of comparative fatigue tests conducted in 3 point bending of HPDC CA313 alloy samples for the as-cast, T4 and T6 conditions, where the T4 and T6 tempers were prepared according to the present invention.

FIG. 19 shows a representation of results of fatigue testing for HPDC CA313 alloy having the same composition as detailed for FIG. 15, tested either in the as-cast condition, the T4 condition according to the process of the present invention, or the T6 condition according to the process of the present invention. Samples were of the same dimensions as the flat test bars described in reference to Table VII and were solution treated for a total immersion time of 15 minutes at 480° C. before quenching and ageing. Fatigue testing was carried out in a three point bend testing rig, at a cyclic load ranging from 31 to 310N. The data shown in FIG. 19 is for an average of at least 5 individual tests. The fatigue life at this load level is increased above that of the as-cast condition for both the T4 and T6 tempers.

Figure 20:
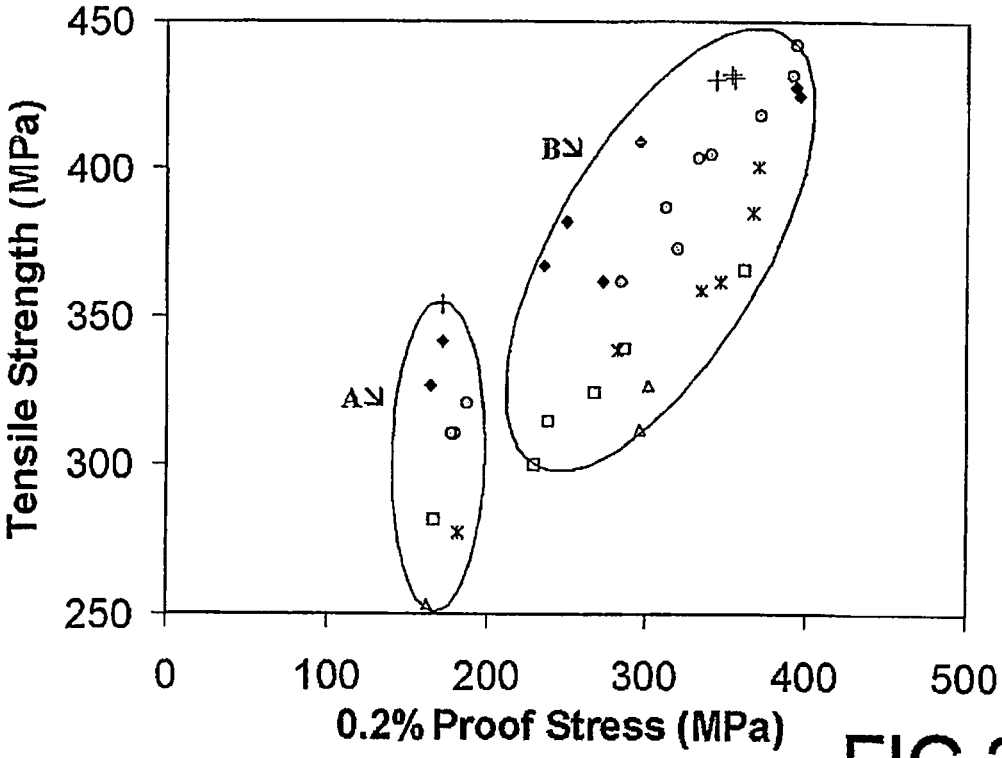
FIG. 20 is a plot of 0.2% proof stress against tensile strength for aluminium alloys CA605 and CA313 within the appropriate composition ranges, as cast by conventional HPDC, and for castings of those same composition ranges, heat treated to different tempers developed according to the present invention.

FIG. 20 shows a plot of 0.2% proof stress against tensile strength for aluminium alloys corresponding to alloys that are within the specifications for the compositions of CA605 alloy and CA313 alloy in the as-cast condition as well as for castings of the same compositions from the same casting batches heat treated to various tempers according to the present invention. Each data point represents the mean of 5-10 tensile samples. The as-cast properties are labelled as "A". The heat treated data points are for different tempers, all of which are in accord with the present invention and are labelled "B".

Figure 21:
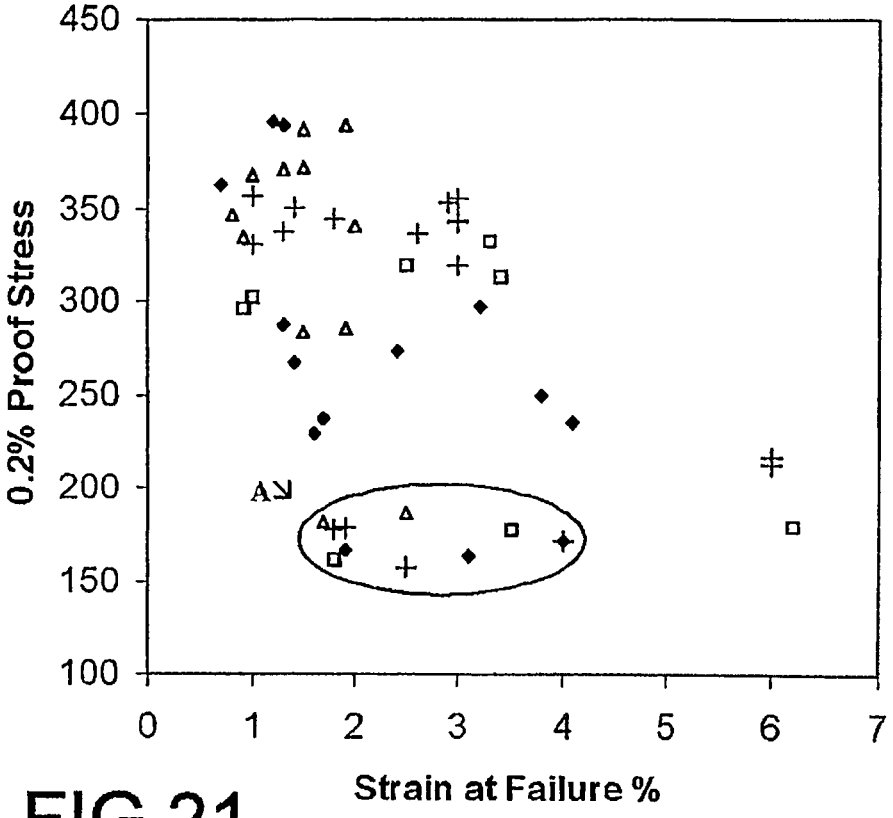
FIG. 21 is a plot of 0.2% proof stress against elongation (% strain at failure) for as cast alloys and alloys heat treated to different tempers developed according to the present invention.

FIG. 21 shows a plot of proof strength against % elongation at failure for a range of tempers according to the present invention compared to as-cast alloy "A". Typically, the strength is increased and in some instances, the elongation was also increased.

The process of the present invention is not limited to current composition ranges of aluminium HPDC alloys. Composition ranges for specifications on HPDC alloy vary from country to country but most alloys have equivalent or overlapping alloy compositions. The effect of alloy chemistry on tensile properties was examined using a range of 9 different alloys, some of which fall within current alloy specifications and some which are experimental compositions. Results shown in Tables VIII-XVI are presented for the as-cast condition, the as-solution treated condition (solution treated according to the present invention and immediately tested) the T4 temper (2 weeks natural ageing at 25° C.) and the T6 temper (24 h ageing at 150° C.). For all of Tables VIII to XVI, the shot in-gate velocity was kept constant at 82 m/s.

In addition, in Table VIII, the effect of a T8 temper is shown where the as-solution treated alloy was cold worked 2% by stretching prior to artificial ageing for the same duration as the T6 alloy. For Table VIII, all quenching from solution treatment was conducted into cold water with the exception as noted where the alloy was aged to a T6 temper following a quench from solution treatment into hot water at 65° C. The T8 temper shown in Table VIII reflects the possibility that a forming operation such as straightening may be required during fabrication of the alloy. The example provided for quenching into hot water and holding such as at 65° C. reflects a common industry practice in heat treatment of Al—Si based casting alloys.

In each instance changes to the tensile properties of the alloys are evident. Characteristically and quite surprisingly, the as-solution treated alloy in every condition shows effectively double or greater, the elongation of the as-cast alloy. In the T4 temper the elongation is characteristically higher than the as-cast condition, and the 0.2% proof stress and tensile strength of the alloys are improved. In the T6 temper, the elongation is typically only slightly lower than the as-cast condition, but the 0.2% proof stress and tensile strength are significantly improved.

TABLE VIII

| Base Alloy 1: Al—9Si—3.1Cu—0.86Fe—0.53Zn—0.16Mn—0.11Ni—0.1Mg—(<0.1 Pb, Ti, Sn, Cr) | | | |
|---|---|---|---|
| condition | 0.2% Proof Stress | Tensile Strength | % elongation at failure |
| As Cast | 172 MPa | 354 MPa | 4% |
| As solution treated at 490° C. 15 min.& cold water quench. | 127 MPa | 334 MPa | 8% |
| T4 25° C. age | 217 MPa | 387 MPa | 6% |
| T6: 150° C. age | 356 MPa | 431 MPa | 3% |

TABLE VIII-continued

| Base Alloy 1: Al—9Si—3.1Cu—0.86Fe—0.53Zn—0.16Mn—0.11Ni—0.1Mg—(<0.1 Pb, Ti, Sn, Cr) | | | |
|---|---|---|---|
| condition | 0.2% Proof Stress | Tensile Strength | % elongation at failure |
| T8 (2% Strain) 150° C. age | 366 MPa | 407 MPa | 3% |
| T6 (hot water quench) 150° C. age | 351 MPa | 438 MPa | 3% |
| T6 177° C. age | 320 MPa | 404 MPa | 3% |
| T6 165° C. age | 337 MPa | 417 MPa | 3% |
| T7 177° C. overage | 309 MPa | 401 MPa | 3.5% |

TABLE IX

| D Alloy 2: Al—9.1Si—3.2Cu—0.86Fe—0.6Zn—0.14Mn—0.11Ni—0.29Mg—(<0.1 Pb, Ti, Sn, Cr) | | | |
|---|---|---|---|
| condition | 0.2% Proof Stress | Tensile Strength | % elongation at failure |
| As Cast | 189 MPa | 358 MPa | 3% |
| As solution treated at 490° C. 15 min. and cold water quench | 126 MPa | 341 MPa | 8% |
| T4 | 246 MPa | 411 MPa | 5% |
| T6 | 374 MPa | 458 MPa | 2% |

TABLE X

| A Alloy 3: Al—8.3Si—4.9Cu—0.98Fe—0.5Zn—0.21Mn—0.1Ni—0.09Mg—(<0.1 Pb, Ti, Sn, Cr) | | | |
|---|---|---|---|
| condition | 0.2% Proof Stress | Tensile Strength | % elongation at failure |
| As Cast | 193 MPa | 363 MPa | 3% |
| As solution treated at 490° C. 15 min. and cold water quench | 142 MPa | 349 MPa | 7% |
| T4 | 244 MPa | 412 MPa | 6% |
| T6 | 381 MPa | 446 MPa | 2% |

TABLE XI

| B Alloy 4: Al—8.7Si—4.9Cu—1Fe—0.53Zn—0.2Mn—0.12Ni—0.29Mg—(<0.1 Pb, Ti, Sn, Cr) | | | |
|---|---|---|---|
| condition | 0.2% Proof Stress | Tensile Strength | % elongation at failure |
| As Cast | 205 MPa | 369 MPa | 3% |
| As solution treated at 490° C. 15 min. & cold water quench | 147 MPa | 333 MPa | 6% |
| T4 | 275 MPa | 418 MPa | 4% |
| T6 | 440 MPa | 490 MPa | 2% |

TABLE XII

| C Alloy 5: Al—9.2Si—3.11Cu—0.9Fe—2.9Zn—0.16Mn—0.11Ni—0.09Mg—(<0.1 Pb, Ti, Sn, Cr) | | | |
|---|---|---|---|
| condition | 0.2% Proof Stress | Tensile Strength | % elongation at failure |
| As Cast | 165 MPa | 347 MPa | 4% |
| As solution treated at 490° C. 15 min. & cold water quench | 123 MPa | 339 MPa | 8% |
| T4 | 224 MPa | 405 MPa | 7% |
| T6 | 370 MPa | 442 MPa | 3% |

TABLE XIII

| E Alloy 6: Al—9.1Si—4.2Cu—1.3Fe—1.2Zn—0.2Mn—0.12Ni—0.22Mg—(<0.1 Pb, Ti, Sn, Cr) | | | |
|---|---|---|---|
| condition | 0.2% Proof Stress | Tensile Strength | % elongation at failure |
| As Cast | 198 MPa | 351 MPa | 2.5% |
| As solution treated at 490° C. 15 min. and cold water quench | 136 MPa | 340 MPa | 6% |
| T4 | 267 MPa | 405 MPa | 3% |
| T6 | 437 MPa | 484 MPa | 2% |

TABLE XIV

| H Alloy 7: Al—8.6Si—3.6Cu—0.93Fe—0.53Zn—0.18Mn—0.11Ni—0.1Mg—(<0.1 Pb, Ti, Sn, Cr) | | | |
|---|---|---|---|
| condition | 0.2% Proof Stress | Tensile Strength | % elongation at failure |
| As Cast | 176 MPa | 358 MPa | 4% |
| As solution treated at 490° C. 15 min. and cold water quench | 137 MPa | 343 MPa | 7% |
| T4 | 234 MPa | 397 MPa | 5% |
| T6 | 379 MPa | 457 MPa | 3% |

TABLE XV

| I Alloy 8: Al—8.6Si—3.6Cu—1Fe—0.53Zn—0.2Mn—0.11Ni—0.3Mg—(<0.1 Pb, Ti, Sn, Cr) | | | |
|---|---|---|---|
| condition | 0.2% Proof Stress | Tensile Strength | % elongation at failure |
| As Cast | 200 MPa | 362 MPa | 3% |
| As solution treated at 490° C. 15 min. & cold water quench | 146 MPa | 349 MPa | 7% |
| T4 | 256 MPa | 411 MPa | 4% |
| T6 | 419 MPa | 481 MPa | 2% |

TABLE XVI

| J Alloy 9: Al—9.2Si—4Cu—1Fe—0.56Zn—0.19Mn—0.12Ni—0.7Mg—(<0.1 Pb, Ti, Sn, Cr) | | | |
|---|---|---|---|
| condition | 0.2% Proof Stress | Tensile Strength | % elongation at failure |
| As Cast | 237 MPa | 377 MPa | 2% |
| As solution treated at 490° C. 15 min. & cold water quench | 148 MPa | 394 MPa | 6.5% |
| T4 | 261 MPa | 413 MPa | 4% |
| T6 | 413 MPa | 474 MPa | 2% |

Table XVII shows the reduction to practice of the invention as it was applied to a statistical number of high pressure die-castings produced industrially. The castings had the following characteristics:

Casting A: Alloy CA313: Complex part, thin walls, constant thickness and weight about 54 g Casting B: Alloy CA313: Simple part, maximum thickness about 8 mm, minimum thickness about 2 mm, and weight about 49 g Casting C: Alloy CA313: Complex part, thin and thick sections in same casting, maximum thickness about 7 mm, minimum thickness about 2 mm, and weight about 430 g Casting D: Alloy CA605: Simple part, thick walled, constant thickness sections. maximum thickness about 15 mm, and weight about 550 g Casting E: Alloy CA605: As D, but different part, and weight about 515 g Casting F: Alloy CA605: Highly complex part, multiple thickness sections in same casting, minimum wall thickness 1.4 mm, maximum wall thickness about 15 mm.

It should be noted that alloy CA313 has a nominal specification of Al-(7.5-9.5)Si-(3-4)Cu-<3Zn-<1.3Fe-<0.5Mn-<0.5Ni-<0.35Pb-<0.3Mg-<0.25Sn-<0.2Ti-<0.1Cr<0.2 other elements; while alloy CA605 has a nominal specification of Al-(9-10)Si-(0.7-1.1)Fe-<0.6Cu-(0.45-0.6Mg)-<0.5Ni-<0.5Zn-<0.15Sn-<0.25 other elements.

As each of the castings A through F was produced at different times, the compositions are expected to vary within these given ranges.

Figure 22:
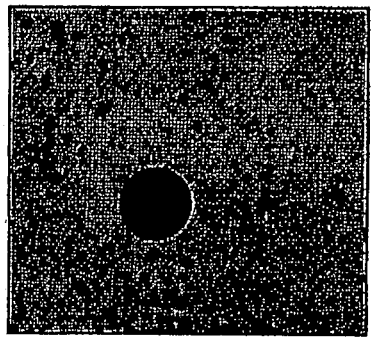
FIG. 22 is an X-ray radiograph of a industrially produced part with a wall thickness of ~15 mm, showing porosity within the sample near a cast in bolt hole with a diameter of 8 mm produced from CA605 alloy.

Castings A through F were all produced under industrial conditions. All castings were x-rayed before heat treatment. The 75 castings of A were relatively free of large porosity as determined by x-ray inspection, although fine porosity was still observable upon close scrutiny at higher magnifications. However, all of the 500 castings B to F showed substantial quantities of fine and large porosity, of sizes up to 10 mm in dimension. An example of this porosity is shown in FIG. 22, for a casting from the set of Casting E X-rayed before heat treatment. FIG. 22 is of a section with a cast in bolt hole showing as a circular feature for reference, with a diameter of 8 mm. Dark contrast features within the radiograph are porosity arising from the die-casting process.

Castings D and E were received in a condition wherein the surface of the castings had been shot blasted to remove a thin layer of material and create a rough finish.

For each part, a heat treatment schedule according to the routine determination of process window according to the current invention was determined, and all parts were heat treated to a T6 temper in air and then air cooled.

A visual rating was given to each part based on a quality inspection. This was based on the following criteria: a "perfect" rating was given to parts displaying equal to or better than the as-cast surface finish, no blistering and no dimensional instability.

An "acceptable" rating was given to parts displaying one small surface blister, of the order of 1 mm or less in size and typically requiring significant scrutiny to detect.

A "reject" rating was given to parts displaying one large blister, multiple small blisters, or a cluster of blisters.

TABLE XVII

Statistical analysis and ratings of heat treated parts

| Casting | Number | Perfect | Acceptable | Reject | Reject rate |
|---|---|---|---|---|---|
| A | 75 | 72 | 2 | 1 | 1% |
| B | 100 | 94 | 5 | 1 | 1% |
| C | 100 | 86 | 12 | 2 | 2% |
| D | 100 | 93 | 7 | 0 | 0% |
| E | 100 | 82 | 17 | 1 | 1% |
| F | 100 | 82 | 15 | 3 | 3% |
| Total | 575 | 509 | 58 | 8 | 1.4% |

Therefore, nearly 89% of all parts heat treated showed a perfect surface finish with no blisters or dimensional instability, 10% showed one minor blister that took close examination to detect, and 1.4% showed a large blister or blister cluster that led to it being classed as a reject.

The invention has the following main benefits over known conventional processes. Conventionally produced HPDC alloys are not known to be heat treatable, due to the occurrence of blistering. Without recourse to an applied high vacuum or the use of a reactive gas, age hardenable aluminium alloy castings produced from conventional HPDC can be suitably solution treated without blistering provided the time at temperature is kept within the appropriate process parameters described herein. The castings thus are able to be visibly sound for automotive and other consumer applications. The alloy of the castings can be precipitation hardened or strengthened producing substantially higher properties than the as-cast material. In many instances, the T4 temper produces improvements in the ductility. These benefits to mechanical properties are also summarised by FIGS. 20 and 21, which show the 0.2% proof stress, tensile strength and elongation data for high pressure die-castings heat treated by the present invention, compared to the properties of as-cast high pressure die-castings. The data shown within FIGS. 20 and 21 shows the differences between as-cast tensile properties compared with those obtainable by temper variants of the current invention. For the heat treated tempers, the process of solution treatment of porous high pressure die-casting alloys without blistering and subsequent heat treatment is conducted utilising the herein described heat treatment procedures.

The invention also can be applied to age-hardenable aluminium alloys which have not previously been designated or regarded as casting alloys, as a means to develop superior mechanical and/or chemical and/or physical and/or processing attributes.

The invention also relates to alloys having additions of trace elements whose addition modifies the processing routes or precipitation processes, as a means to develop superior mechanical and/or chemical and/or physical attributes.

Each of FIGS. 23 to 32 relates to high pressure die castings made from CA313 alloy. The castings were made on a Toshiba horizontal cold-chamber machine with a 250 tonne locking force, a shot sleeve internal diameter of 50 mm and a length of 400 mm, using an in-gate velocity of 26 m/s. The castings were cylindrical tensile specimens, and they were produced without use of an applied vacuum or a reactive gas and contained typical levels of porosity.

Figure 23:
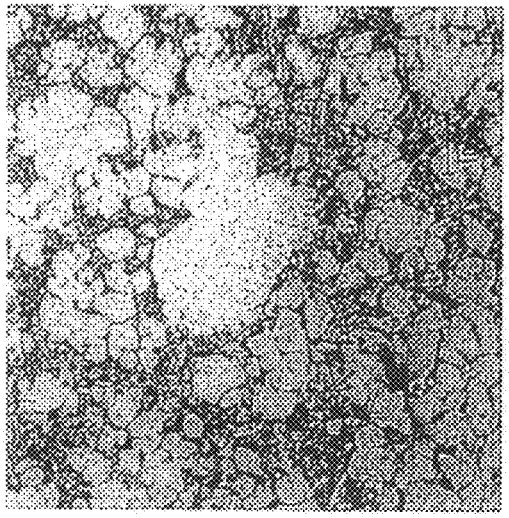
FIGS. 23 and 24 are optical micrographs taken from cross sections of a high pressure die-casting of CA313 alloy, at an edge and at the centre of the casting, respectively.
Figure 24:
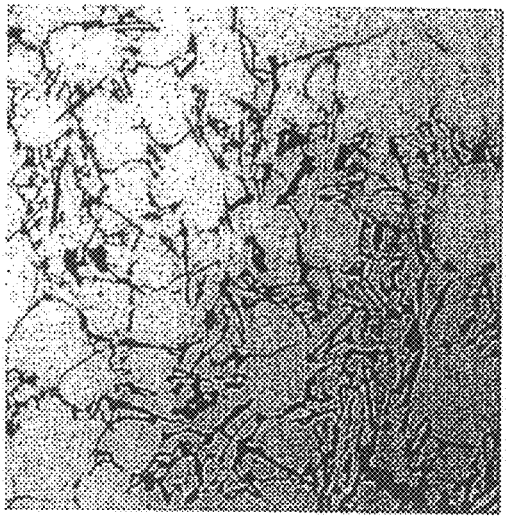
Figure 25:
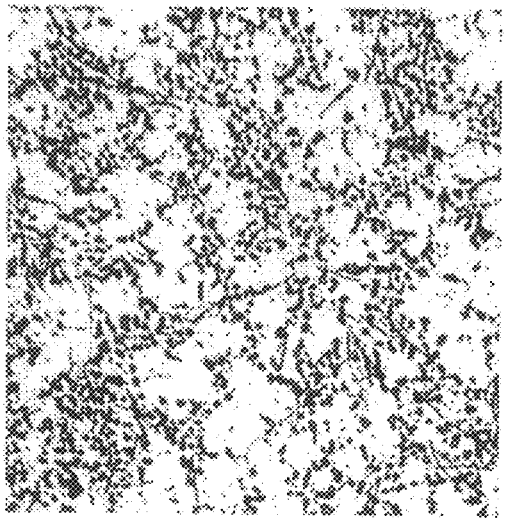
FIGS. 25 and 26 correspond to FIGS. 23 and 24, respectively, but show the microstructure of the casting after a solution treatment in accordance with stage (a) of the method of the present invention.
Figure 26:
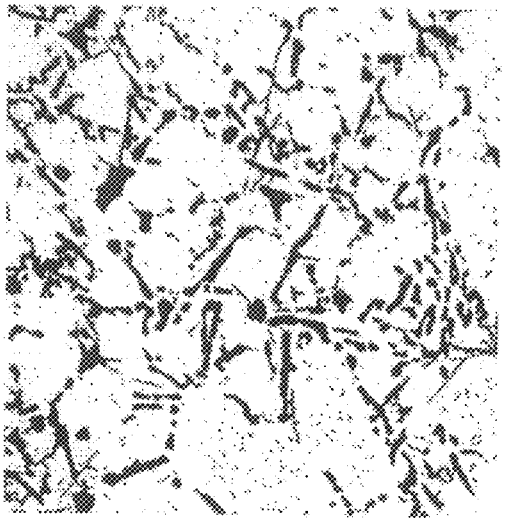

FIGS. 23 to 26 show respective optical micrographs, each at the same magnification indicated in FIG. 23 by the 10 μm scale bar. FIGS. 23 and 24 show typical micrographs of castings in the as cast condition, taken respectively at edge and centre regions. FIGS. 23 and 24 show the usual variation in α-aluminium and eutectic phases between those regions. FIGS. 25 and 26 show micrographs of equivalent castings as FIGS. 23 and 24, after the casting had been subjected to solution treatment at 490° C. for a period (including the time in heating to 490° C.) of 15 minutes. The FIGS. 25 and 26, taken respectively at edge and centre regions, show a surprising level of spheroidisation of the eutectic silicon achieved in that short solution treatment time.

Figure 27:
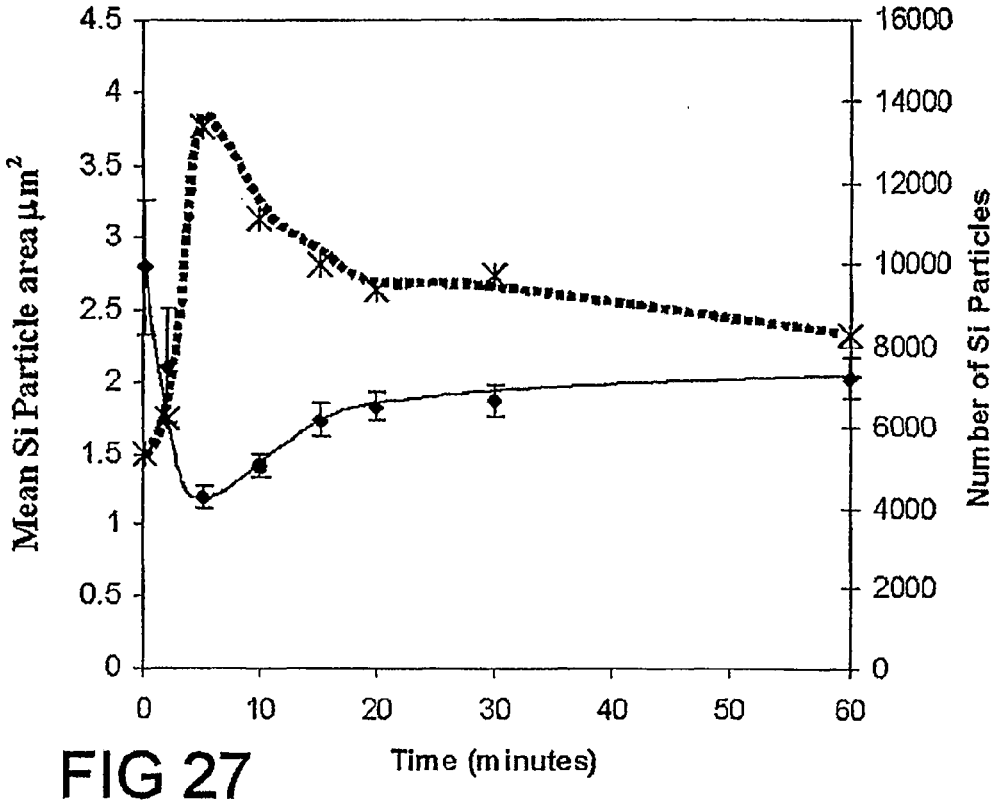
FIG. 27 shows plots of mean silicon particle area and number of silicon particles for a fixed area of 122063 $\mu m^2$ from 5 individual fields for each data point, each against time at solution treatment temperature at edge regions such as shown in FIG. 25.
Figure 28:
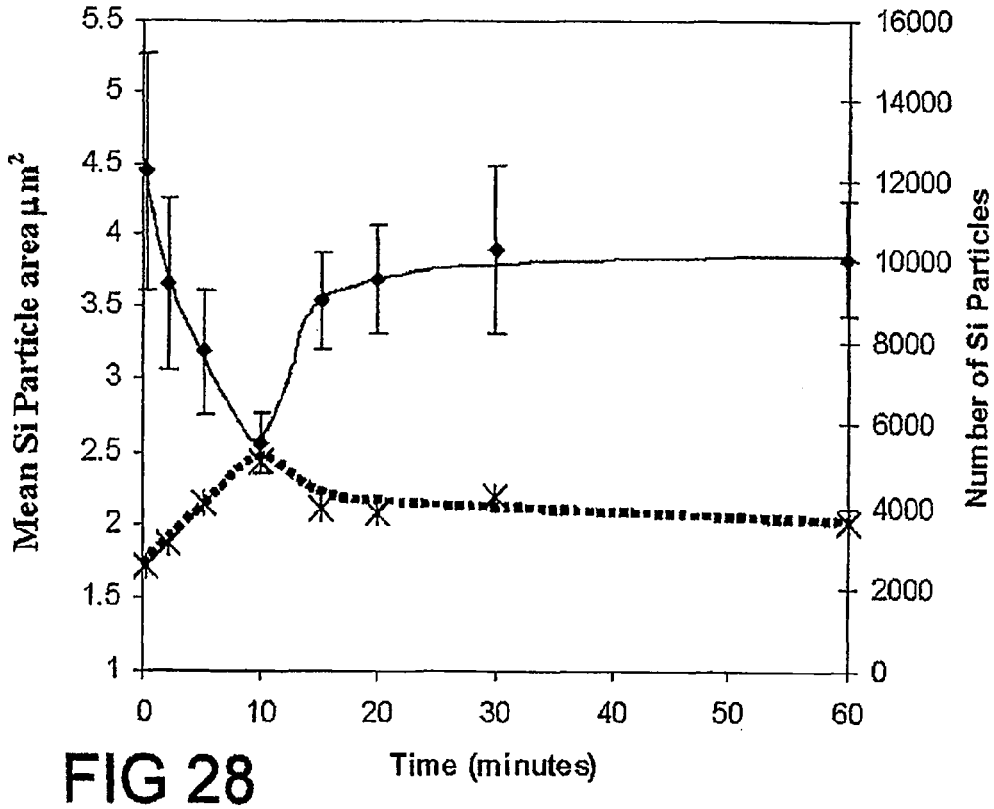
FIG. 28 is similar to FIG. 27 but is in respect of the centre of the casting shown in FIG. 26.

FIGS. 27 and 28 show a respective plot of variation in mean silicon particle area (closed diamonds), and of the variation in the number of silicon particles (asterisks), with solution treatment time at 490° C. for castings of the round tensile specimens of CA313 alloy shown in FIG. 8. The data for FIG. 27 was taken at edge regions of the castings, while that for FIG. 28 was taken at centre regions. The plots of FIGS. 27 and 28 differ as a consequence of the difference in microstructure between those regions shown by FIGS. 23 to 26. Each data point on the plots was taken from a fixed area from multiple fields of view, being a standard area of 122063 $\mu m^2$. Also, in line with FIGS. 25 and 26, the plots of FIGS. 27 and 28 show a substantial variation in the area and number of silicon particles achieved within the short solution treatment time required by the present invention compared with longer solution treatment times. For the plots of FIGS. 27 and 28, test samples in the different conditions were sectioned with a diamond saw at precisely the same location on equivalent samples prior to polishing.

With reference to the data of FIGS. 23 to 28, silicon particles initially appear to fragment during the solution treatment, giving a smaller mean particle area with larger particle numbers. The particles then grew, with growth slowing at about 20 minutes solution treatment time (including heating to temperature), at the chosen solution treatment temperature of 490° C. For these CA313 castings, when heat treated in accordance with the present invention, blistering begins to become evident with a 20 minute solution treatment time (including heating to temperature) and to become progressively more unacceptable with longer solution treatment times.

The results illustrated by FIGS. 25 and 26 and explained by FIGS. 27 and 28 are very surprising, as it would not be expected that Si spheroidisation would occur so quickly. This is not to suggest that the avoidance of blistering with the heat treatment process of the present invention is a direct result of the rapid spheroidization of silicon. However, the data of FIGS. 25 to 28 highlights the speed with which microstructural change is able to occur at the solution treatment temperature well prior to full dissolution of solute elements, while it is evident that avoidance of blistering is attributable to some aspect of the overall changes that occur.

Figure 29:
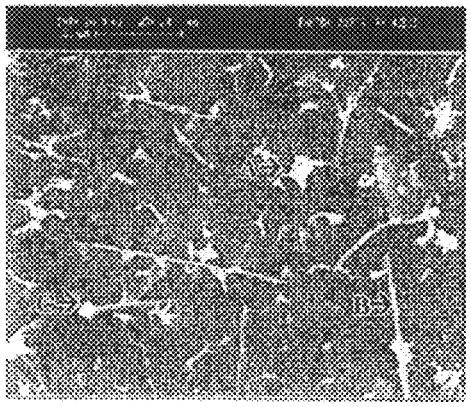
FIGS. 29 and 30 show backscattered scanning electron microscopy (SEM) images for the casting in the respective conditions for FIGS. 23 to 26.
Figure 30:
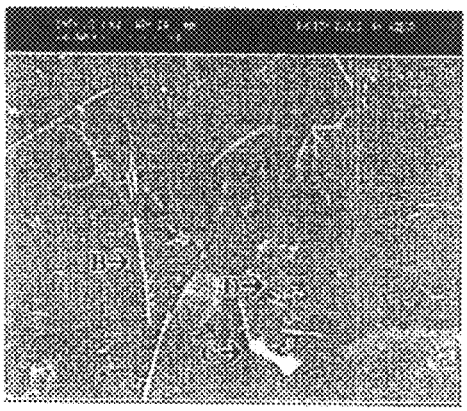

FIGS. 29 and 30 are backscattered scanning electron microscopy (SEM) micrographs of the as cast and heat treated castings, either as-cast or in a T6 temper. In the images of FIGS. 29 and 30, bright phases show contrast arising from copper (an example is labelled as "A") and iron containing particles (examples labelled as "B" and "C"). Silicon is not seen because of the closeness of its atomic number to that of aluminium. Iron containing particles are present as needles (example labelled "B") or as angular features (example labelled "C") both of which are less bright white than the copper containing particles. A comparison of FIGS. 29 and 30 shows that following the procedure of this invention, a substantial amount of the copper rich phase is dissolved during the solution treatment step of the invention. An example of the residue of the copper rich particles following the heat treatment procedure is labelled "D", being the small speckled particles of which were found by compositional analysis to contain undissolved copper.

Figure 31:
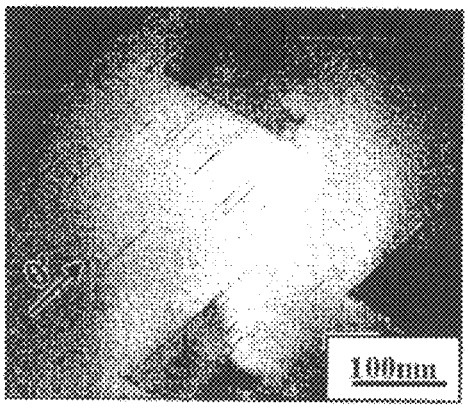
FIG. 31 shows a transmission electron microscopy (TEM) image of the casting of FIGS. 23, 24 and FIG. 29, in the as cast condition.
Figure 32:
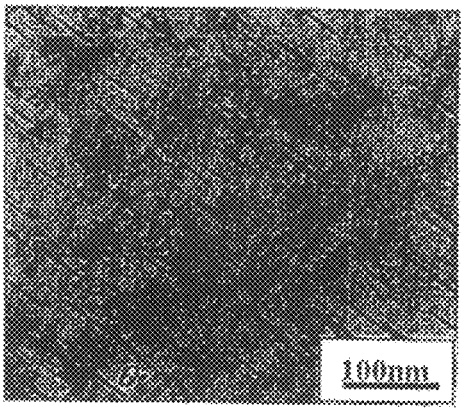
FIG. 32 is similar to FIG. 31, but shows the alloy as treated to a T6 temper in accordance with the present invention.

FIG. 31 shows a transmission electron microscope (TEM) image of the as cast alloy of a CA313 alloy casting, taken close to $[101]_\alpha$. This shows the α-aluminium grains to be exhibiting very few strengthening θ' precipitates (direction of precipitates is arrowed). Further analysis found that some α-aluminium grains in the as-cast condition were apparently completely devoid of strengthening precipitation. FIG. 32 is a TEM image also taken close to $[101]_\alpha$ of an equivalent casting after being heat treated according to the present invention, in which it was solution heat treated at 490° C. for 15 minutes, quenched in cold water and then artificially aged to peak strength at 150° C. and shows a substantial change in the size and distribution of strengthening θ' precipitates.

Finally, it is to be understood that various alterations, modifications and/or additions may be introduced into the constructions and arrangements of parts previously described without departing from the spirit or ambit of the invention.

The invention claimed is:

1. A method for the heat treatment of a high pressure die cast casting which exhibits gaseous or other porosity and is of an age-hardenable aluminium alloy having 4.5 to 20 wt % Si, 0.05 to 5.5 wt % Cu, 0.1 to 2.5 wt % Fe, 0.01 to 1.5 wt % Mg, at least one of Ni up to 1.5 wt %, Mn up to 1 wt % and Zn up to 3.5 wt %, and a balance of aluminium and incidental impurities, wherein the method comprises the steps of:

(a) heating the casting, which is made by conventional high pressure die casting without application of high vacuum or use of a reactive gas, to and within a temperature range that allows solute elements to be taken into solid solution (solution treatment), wherein the heating is:

(i) to and within a range of from a temperature of 20° C. below the solidus melting temperature for the alloy of the casting to a temperature of 150° C. below the solidus melting temperature for the alloy of the casting, said temperature of 20° C. below the solidus melting temperature being a temperature not exceeding 525° C., and (ii) for a period of time of less than 30 minutes;

(b) cooling the casting from the temperature range for step (a) by quenching the casting into a fluid quenchant at a temperature between 0° C. and 100° C.; and (c) obtaining a hardened or strengthened casting that is at least substantially without blistering by ageing the quenched casting from step (b) in a natural or artificial ageing temperature range of from 0° C. to 250° C.

2. The process of claim 1, wherein the ageing in step (c) is natural ageing at ambient temperatures of from 0° C. to 45° C.

3. The process of claim 1, wherein the quenching of step (b) is to a temperature suitable for the strengthening of step (c).

4. The process of claim 1, wherein the ageing in step (c) is artificial ageing.

5. The process of claim 4, wherein the artificial ageing is conducted by heating the quenched casting to at least one temperature in the range of from 50° C. to 250° C.

6. The process of claim 4, wherein the artificial ageing is conducted by heating the quenched casting in the temperature range of from 130° C. to 220° C.

7. The process of claim 1, wherein step (a) of claim 1 is conducted in part, non-isothermally.

8. The process of claim 1, wherein step (a) is conducted substantially completely non-isothermally.

9. The process of claim 1, wherein part of step (a) is conducted substantially isothermally.

10. The process of claim 1, wherein the casting is preheated to a temperature in the range of 100° C. to 350° C. before stage (a).

11. The processes of claim 1, wherein stage (c) is conducted in the range of 0° C. up to 250° C.

12. The process of claim 11, wherein the casting after step (c) is in an underaged condition compared to a full T6 temper.

13. The process of claim 11, wherein the casting after step (c) is in a peak aged condition compared to a full T6 temper.

14. The process of claim 11, wherein the casting after step (c) is in an overaged condition compared to a full T6 temper.

15. The process of claim 1, wherein the casting is cold worked between step (b) and step (c).

16. The process of claim 3, wherein the cooling from the ageing temperature of step (c) is by quenching.

17. The process of claim 3, wherein the cooling from the ageing temperature of step (c) is by slowly cooling in air or another medium.

18. The process of claim 1, wherein the casting following step (c) is devoid of surface blisters.

19. The process of claim 1, wherein the casting following step (c) is devoid of dimensional change.

20. The process of claim 2, wherein the natural ageing is at a temperature of from 15° C. to 25° C.

21. The process of claim 11, wherein stage (c) is conducted at from 0° C. to 45° C.

22. The process of claim 11, wherein stage (c) is conducted at from 15° C. to 25° C.

23. The process of claim 11, wherein stage (c) is conducted at from 50° C. to 250° C.

24. The process of claim 11, wherein stage (c) is conducted at from 130° C. to 250° C.

* * * * *

UNITED STATES PATENT AND TRADEMARK OFFICE

CERTIFICATE OF CORRECTION

PATENT NO. : 8,409,374 B2
APPLICATION NO. : 11/793023
DATED : April 2, 2013
INVENTOR(S) : Lumley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 362 days.

Signed and Sealed this
First Day of September, 2015

Michelle K. Lee

Michelle K. Lee
*Director of the United States Patent and Trademark Office*